US007942489B2

(12) United States Patent
Ushinohama et al.

(10) Patent No.: US 7,942,489 B2
(45) Date of Patent: May 17, 2011

(54) LIQUID EMITTING APPARATUS AND METHOD

(75) Inventors: Iwao Ushinohama, Kanagawa (JP); Yuichiro Ikemoto, Kanagawa (JP); Kazuyasu Takenaka, Tokyo (JP); Takeo Eguchi, Kanagawa (JP)

(73) Assignee: Sony Corporation, Tokyo (JP)

( * ) Notice: Subject to any disclaimer, the term of this patent is extended or adjusted under 35 U.S.C. 154(b) by 92 days.

(21) Appl. No.: 10/574,152

(22) PCT Filed: Oct. 4, 2004

(86) PCT No.: PCT/JP2004/014611

§ 371 (c)(1),
(2), (4) Date: Mar. 29, 2006

(87) PCT Pub. No.: WO2005/032823

PCT Pub. Date: Apr. 14, 2005

(65) Prior Publication Data

US 2007/0008380 A1 Jan. 11, 2007

(30) Foreign Application Priority Data

Oct. 2, 2003 (JP) ..... P2003-344971

(51) Int. Cl.
*B41J 29/38* (2006.01)

(52) U.S. Cl. ..... 347/10; 347/9

(58) Field of Classification Search ..... 347/9–12
See application file for complete search history.

(56) References Cited

U.S. PATENT DOCUMENTS

| | | | | |
|---|---|---|---|---|
| 6,439,678 | B1 * | 8/2002 | Norton | 347/9 |
| 2005/0057599 | A1 * | 3/2005 | Takenaka et al. | 347/19 |

FOREIGN PATENT DOCUMENTS

| | | | | |
|---|---|---|---|---|
| EP | 1 506 861 | | | 2/2005 |
| JP | 2000-185403 | A | | 4/2000 |
| JP | 2000-185403 | | | 7/2000 |
| JP | 2002-240287 | | | 8/2002 |
| JP | 2002-240287 | A | | 8/2002 |
| JP | 2002240287 | A | * | 8/2002 |
| JP | 2004-001364 | | | 1/2004 |
| JP | 2004-136628 | | | 5/2004 |
| JP | 2004-160849 | | | 6/2004 |
| JP | 2004-188830 | | | 7/2004 |
| JP | 2004-188956 | | | 7/2004 |
| JP | 2004-262102 | | | 9/2004 |
| JP | 2004-268307 | | | 9/2004 |
| JP | 2004-311725 | | | 11/2004 |

(Continued)

*Primary Examiner* — Julian D Huffman
*Assistant Examiner* — Jason S Uhlenhake
(74) *Attorney, Agent, or Firm* — Robert J. Depke; Rockey, Depke & Lyons, LLC

(57) ABSTRACT

Disclosed is a liquid emitting apparatus for emitting a liquid pressurized by a pressure generated by a pressure generating element is emitted as liquid droplets onto a support. A controller (68) controls an emission controller (63) so that the current value of the pulse current supplied to a heating resistor (42*a*) will have a current value difference within ±10% with respect to the current value of the pulse current supplied to a heating resistor (42*b*). By so doing, variations in the position of deposition of an ink droplet i emitted with variable emitting directions may be suppressed to enable printing to a high-quality image in which deterioration in the image quality variations ascribable to color time variations or white streaks is prohibited.

18 Claims, 20 Drawing Sheets

FOREIGN PATENT DOCUMENTS

| | | |
|---|---|---|
| JP | 2005-001346 | 1/2005 |
| JP | 2005-007664 | 1/2005 |
| JP | 2005-007723 | 1/2005 |
| JP | 2005-014465 | 1/2005 |
| JP | 2005-022156 | 1/2005 |
| JP | 2005-059443 | 3/2005 |
| JP | 2006-069225 | 3/2006 |
| JP | 2006-082564 | 3/2006 |
| JP | 2006-082565 | 3/2006 |
| WO | WO 2004-082943 | 3/2004 |

* cited by examiner

LIQUID EMITTING APPARATUS AND METHOD

TECHNICAL FIELD

This invention relates to liquid emitting methods and apparatus for emitting a liquid, thrust by a pressure generated by a pressure generating device, onto a support via emitting port in the form of liquid droplets.

The present application is a 371 U.S. National Stage filing of PCT/JP2004/014611, filed Oct. 4, 2004, which claims priority to Japanese Patent Application JP-2003-344971 filed in the Japanese Patent Office on Oct. 2, 2003, the entire contents of which being incorporated herein by reference.

BACKGROUND ART

As an apparatus for emitting the liquid, there has so far been known a printer apparatus of the ink jet system in which the ink is emitted via liquid emitting head onto a recording paper sheet, as a support, for recording an image or letters/characters thereon. The printer apparatus, employing this ink jet system, has merits that it is low in running costs and small-sized and lends itself to printing an image as a color image. In the printing apparatus of the ink jet system, inks of plural colors, exemplified by yellow, magenta, cyan and black, are supplied from ink cartridges, containing the inks of these various colors, into e.g. ink liquid chambers of a liquid emitting head.

With this printer apparatus, the inks supplied to for example the ink liquid chambers are thrust by pressure generating devices, such as heating resistors, arranged in the ink liquid chambers, so as to be emitted via small-sized ink emitting ports, that is, so-called nozzles, provided in the ink liquid chambers.

Specifically, the inks in the ink chambers are heated by heating resistors, provided within the ink liquid chambers, to generate air bubbles in the inks on the heating resistors. The inks are emitted from the nozzles under the pressure generated in the ink liquid chambers by the air bubbles, with the so emitted inks being deposited on for example a recording paper sheet, as support, for printing an image or letters/characters thereon.

Among the printer apparatus of the ink jet system, there is a serial printer apparatus in which ink cartridges are mounted in a liquid emitting head unit, and in which the liquid emitting head unit, carrying ink cartridges, is moved along the width of the recording paper sheet, that is, in a direction substantially at right angles to the running direction of the recording paper sheet, for depositing the inks of preset colors on the sheet. There is also a line printer apparatus having a range approximately equal to the width of the recording paper sheet as the ink emitting range. The inks are emitted in a line from nozzles of the liquid emitting head arrayed along the width of the recording paper sheet.

With the serial printer apparatus, the running of the recording paper sheet is stopped as the liquid emitting head unit is being moved in a direction substantially at right angles to the running direction of the recording sheet. The inks are emitted and deposited on the recording paper sheet as the liquid emitting head unit is being moved, with the recording paper sheet being at a standstill. This sequence of operations is repeated. With the line printer apparatus, the liquid emitting head unit is fixed completely, or fixed incompletely to perform minor movements to avoid irregular printing. The liquid emitting head unit emits and deposits the inks linearly on the recording paper sheet which is running continuously.

With the line printer apparatus, in distinction from the serial printer apparatus, the liquid emitting head unit is not moved. Hence, printing may be made at a higher speed with the line printer apparatus than with the serial printer apparatus. Moreover, since it is unnecessary with the line printer apparatus to cause movement of the liquid emitting head unit, each ink cartridge may be larger in size, with the consequence that the ink holding capacity of the ink cartridge may be correspondingly increased. Since the liquid emitting head unit is not moved with the line printing apparatus, the liquid emitting head unit may be provided as one with each ink cartridge, by way of simplifying the constitution.

With the above-described line printer apparatus, the accuracy with which images or letters/characters are printed is affected by the accuracy of timing of deposition of the inks on the running recording paper sheet. More specifically, there is presented such a problem that, with a higher running speed of the recording paper sheet, the images or letters/characters recorded are printed elongated in the running direction of the recording paper sheet, whereas, with a slower running speed of the recording paper sheet, the images or letters/characters recorded are printed contracted in the running direction.

For removing this inconvenience, the line printer apparatus uses e.g. a servo motor, for controlling a motor used for running the recording paper sheet, and the running speed is made constant such as to avoid irregular running speed of the recording paper sheet, thereby controlling the timing of deposition of the inks thereon.

With the use of the servo motor, described above, it is possible to resolve the problem of image elongation or contraction. However, should there be an error as small as several μsec in the timing of ink deposition on the recording paper sheet, the color tone, that is, color density, may become irregular in the running direction of the recording paper sheet. In more detail, should there occur delay of several μsec in the control of the running speed of the recording paper sheet by the servo motor, the color tone becomes dense in the corresponding paper sheet portion.

If the control of the running speed of the recording paper sheet by the servo motor is increased by only a few microns, the color tone becomes thinner in this portion. If the control of the running speed of the recording paper sheet is increased by tens or hundreds of microns, the portions on which no ink has been deposited, that is, so-called white streaks, are generated for extending in a direction substantially perpendicular to the running direction of the recording paper sheet. The irregular color tones or the white streaks, extending in the running direction of the recording paper sheet, appear strongly when printing is made with the gray scale unchanged, as an example.

In the serial printer apparatus, the irregular color tone or the white streaks, occurring in the running direction of the recording paper sheet when printing is carried out as the running of the recording paper sheet is halted, are prevented from being produced by providing a so-called overlap area in a boundary between the previous printing site and the current printing site where the current print area and the previous print area are overlapped with each other. However, even granting that the irregular color tone or white streaks may be prevented from being produced in this serial printer apparatus, such overlap area gives rise to inconveniences such as prolonged time involved in printing, or the increased quantity of the inks used for printing.

In the Japanese laid-Open Patent Publication 2000-185403, it is proposed to tackle this problem by providing a plural number of heating resistors in the ink chambers for facing the ink emitting nozzles of the liquid emitting head so that the heating resistors will be in plane symmetry in a plane containing the nozzle centerlines, and by controlling these heating resistors independently of one another to provide for different heat values of the heating resistors to control the ink emitting directions.

In the liquid emitting head, provided with the plural heating resistors, the respective heating resistors are independently controlled to provide for different heat values of the respective heating resistors to control the directions of emission of the inks from the respective nozzles. Consequently, there is a risk of deterioration of the image quality in case the heat values of the respective heating resistors are inadequate such that the inks cannot be emitted in the desired ink emitting directions.

In more detail, if, in a liquid emitting head 201, shown in FIG. 22, the amounts of the energies supplied to the respective heating resistors 202 are inadequate, the size balance of air bubbles 204, produced in an inks 203 by heating resistors 203 is upset, such that there is a risk that the pressure with which the air bubbles 204 act on the ink 403 is destabilized to cause variable ink emitting directions.

Specifically, with the liquid emitting head 201, if the energies supplied to the respective heating resistors 202 are inadequate, there is a case where the angle of emission θ of an ink droplet i from a nozzle 205 tends to be too small. In this case, in the liquid emitting head 201, the angle of emission θ of an ink droplet i is too small, and hence the ink droplet i touches an edge 205*a* of the nozzle 205 as the ink droplet is emitted from the nozzle 205, with the result that the ink droplet is emitted in variable directions.

Thus, with the liquid emitting head 201, the point of deposition of the ink droplet i on the major surface of the recording paper sheet P tends to be offset to produce irregular color tone or white streaks to deteriorate the image quality. It is therefore crucial to manage proper control of for example the heat values of the respective heating resistors 202, that is, the quantity of the energies, such as the current, supplied to the respective heating resistors 202 to heat the respective heating resistors 202, in order to emit the ink droplets i from the nozzle 205.

DISCLOSURE OF THE INVENTION

Problems to be Solved by the Invention

It is therefore an object of the present invention to provide liquid emitting methods and apparatus whereby it is possible to prevent deterioration of the image quality.

According to the present invention, there is provided, for achieving the above object, a liquid emitting apparatus including a liquid chamber for storing a liquid, a supply unit for supplying the liquid to the liquid chamber, two or more pressure generating elements provided in the liquid chamber for pressurizing the liquid stored in the liquid chamber, emitting means having a plurality of emitting ports for emitting the liquid pressurized by the pressure generating elements onto a major surface of a support from the liquid chamber in the form of liquid droplets, and emission controlling means for controlling the current values supplied to the pressure generating elements for controlling the angle of emission of the liquid droplets from the emission ports. With the current supplied to one of the pressure generating elements, as a reference current, the emission controlling means supplies the current approximately equal to the reference current or the current having a current value difference less than ±10% from the reference current, to the pressure generating element or elements other than the pressure generating element supplied with the reference current.

With this liquid emitting apparatus, the current approximately equal to the reference current, or the current having a current value difference less than ±10% from the reference current, is supplied to the pressure generating element or elements other than the pressure generating element supplied with the reference current, whereby the current supplied to the respective pressure generating elements may be of a proper value. Hence, the balance of the pressures generated in the ink chambers may be optimized and, by this optimized pressure balance, the liquid may be emitted in a desired direction from the emitting ports.

According to the present invention, there is also provided liquid emitting method, for a liquid emitting apparatus including a liquid chamber for storing a liquid, a supply unit for supplying the liquid to the liquid chamber, two or more pressure generating elements provided in the liquid chamber for pressurizing the liquid stored in the liquid chamber, emitting means having a plurality of emitting ports for emitting the liquid pressurized by the pressure generating elements onto a major surface of a support from the liquid chamber in the form of liquid droplets, and emission controlling means for controlling the current values supplied to the pressure generating elements for controlling the angle of emission of the liquid droplets from the emission ports. With the current supplied to one of the pressure generating elements, as a reference current, the current approximately equal to the reference current or the current having a current value difference less than ±10% from the reference current, is supplied to the pressure generating element or elements other than the pressure generating element supplied with the reference current.

With this liquid emitting method, the current approximately equal to the reference current, or the current having a current value difference less than ±10% from the reference current, is supplied to the pressure generating element or elements other than the pressure generating element supplied with the reference current, whereby the current supplied to the respective pressure generating elements may be of a proper value. Hence, the balance of the pressures generated in the ink chambers may be optimized and, by this optimized pressure balance, the liquid may be emitted in a desired direction from the emitting ports.

According to the present invention, in which the currents supplied to the respective pressure generating elements may be optimized to stabilize the emitting direction control. As a result, offsets of the points of deposition of the emitted liquid on the major surface of the support may be suppressed to enable printing with optimum image quality.

Other objects and specified advantages of the present invention will become more apparent from reading the following explanation of preferred embodiments which will now be made with reference to the accompanying drawings.

BEST MODE FOR CARRYING OUT THE INVENTION

Figure 1:
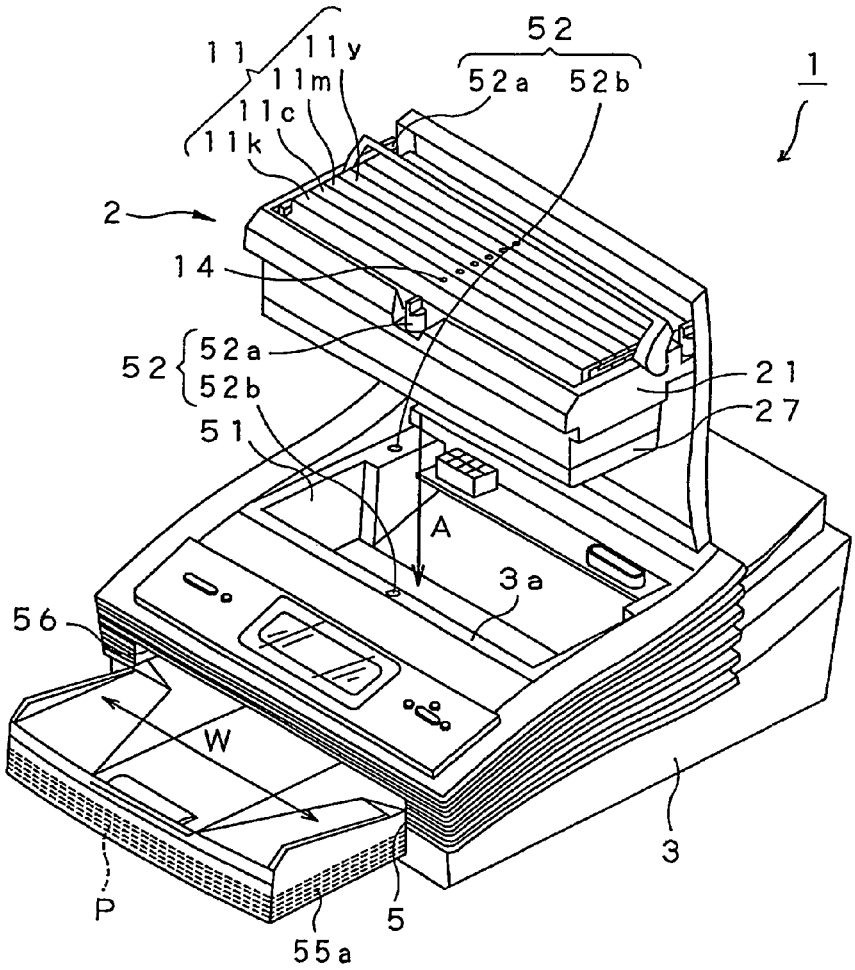
FIG. 1 is a perspective view showing an ink jet printer apparatus embodying the present invention.

The liquid emitting apparatus and methods, embodying the present invention, will now be explained with reference to the drawings.

An ink jet printer apparatus of the present embodiment, shown in FIG. 1, referred to below simply as a printer apparatus, prints images or letters/characters by emitting for example the ink onto a recording paper sheet P running in a predetermined direction. This printer apparatus 1 is a so-called line printer apparatus in which a plural number of ink emitting ports (nozzles) are arranged side-by-side along the width of the recording paper sheet P, that is, in the direction indicated by arrow W in FIG. 1, in keeping with the printing width of the recording paper sheet P.

This printer apparatus 1 includes an ink jet print head cartridge 2, for emitting an ink 4, referred to below simply as a head cartridge, and a printer main 3 on which to mount the head cartridge 2. With the printer apparatus 1, the head cartridge 2 is detachably mounted to the printer main 3, and furthermore, ink cartridges 11*y*, 11*m*, 11*c* and 11*k*, operating as ink supply sources, are detachably mounted to the head cartridge 2.

With the printer apparatus 1, the ink cartridge 11*y*, enclosing therein a yellow ink, the ink cartridge 11*m*, enclosing therein a magenta ink, the ink cartridge 11*c*, enclosing therein a cyan ink, and the ink cartridge 11*k*, enclosing therein a black ink, may be used. The head cartridge 2, detachably mounted to the printer main 3, and the ink cartridges 11*y*, 11*m*, 11*c* an 11*k*, detachably mounted to the head cartridge 2, are consumable supplies and may be exchanged by spare items.

With the printer apparatus 1, the recording paper sheet P, accommodated in a tray 55*a*, may be supplied into the inside of the printer main 3, by mounting the tray 55*a* in a tray mounting section 5 provided on a front side bottom of the printer main 3. The tray has housed therein a stack of the recording paper sheets P. When the tray 55*a* is mounted in the tray mounting section 5, provided in the front side of the printer main 3, the recording paper sheet P is fed by a paper sheet feed/discharge unit 54 from a paper feed port 55 to the back side surface of the printer main 3. The recording paper sheet P, fed to the back side surface of the printer main 3, has its running direction reversed by a reversing roll 83, and is fed from the back side towards the front side of the printer main 3 on a path above a forward or on-going path. On the recording paper sheet P, fed from the back side towards the front side of the printer main 3, printing data corresponding to letter/character data or image data, supplied from an information processing system 69, such as personal computer, are printed as letters/characters or images, before the recording paper sheet P, sent from the back side to the front side of the printer main 3 is discharged from a paper sheet discharge port 56, provided in the front side of the printer main 3 (see FIG. 13).

The head cartridge 2, performing the printing on the recording paper sheet P, is loaded from the upper surface of the printer main 3, that is, from the direction indicated by arrow A in FIG. 1, and emits the ink 4 onto the recording paper sheet P, traveling by a paper sheet feed/discharge unit 54, by way of effecting the printing. Here, the head cartridge 2, detachably mounted to the printer main 3, constituting the printer apparatus 1, and the ink cartridges 11*y*, 11*m*, 11*c* and 11*k*, detachably mounted to the head cartridge 2, will be explained with reference to the drawings.

The head cartridge 2 pressures the ink 4, as an electrically conductive liquid, by the pressure generated by a pressure generating means of, for example, the electro-thermal or electromechanical system, for finely dividing the ink 4 into fine particles, which are then emitted and sprayed in the form of fine droplets on the major surface of a support, such as recording paper sheet P. Specifically, the head cartridge 2 includes a cartridge main 21, on which cartridge main 21 are mounted the ink cartridges 11*y*, 11*m*, 11*c* and 11*k*, which are containers charged with the inks 4 of respective colors. Meanwhile, the ink cartridges 11*y*, 11*m*, 11*c* and 11*k* are sometimes referred to below simply as ink cartridge or cartridges 11.

Figure 3:
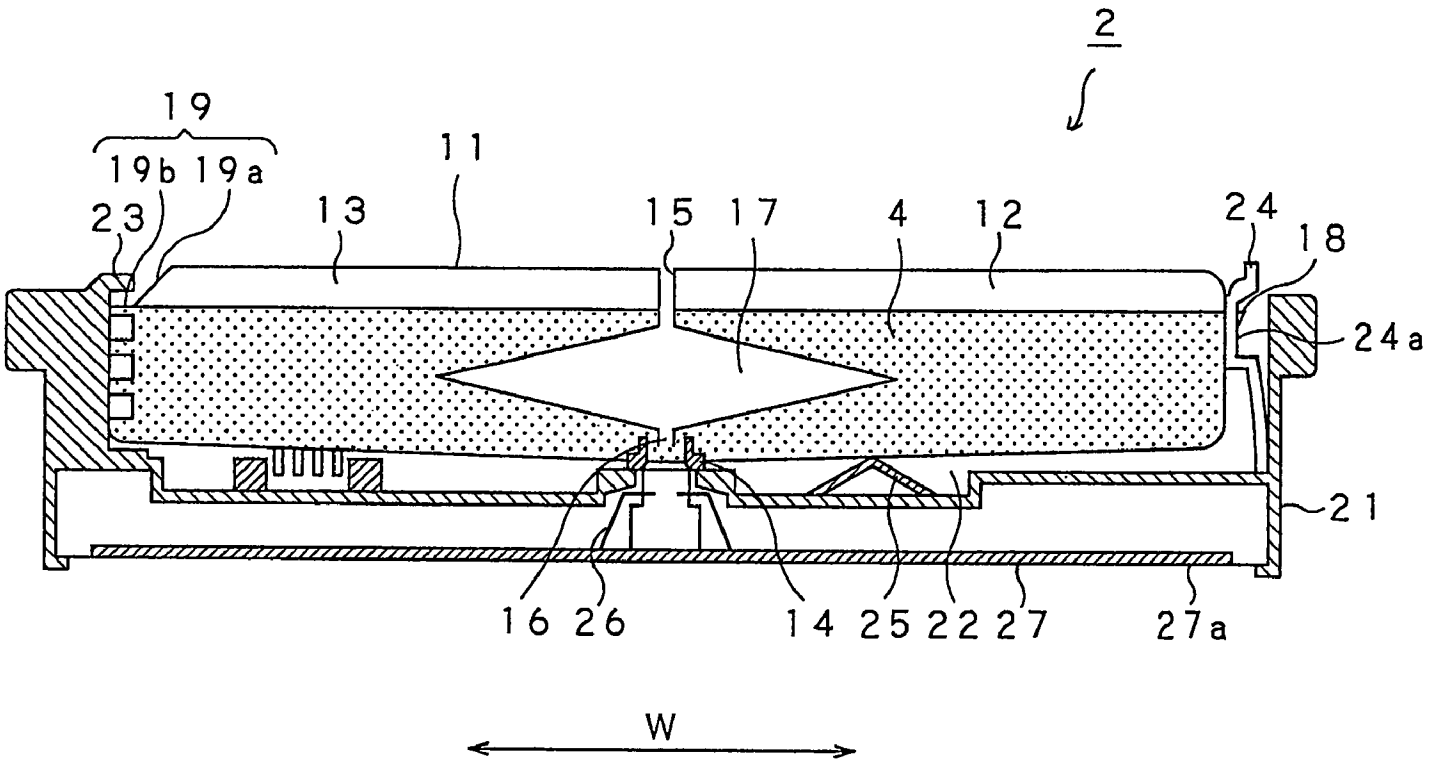
FIG. 3 is a cross-sectional view showing the ink jet print head cartridge.

Each ink cartridge 11, detachably mounted to the head cartridge 2, includes a cartridge vessel 12, molded by injection molding a synthetic resin material, such as polypropylene, exhibiting high strength and resistance against ink, as shown in FIG. 3. The cartridge vessel 12 is formed to a substantially rectangular shape with the length of a longitudinal side thereof approximately equal to the width-wise size of the recording paper sheet P used, such as to provide for the largest possible capacity of the ink stored in its inside.

Specifically, the cartridge vessel 12, forming the ink cartridges 11, is provided with an ink container 13, holding the ink 4, an ink supply unit 14 for supplying the ink 4 from the ink container 13 into the inside of the cartridge main 21 of the head cartridge 2, and an opening for communication with outside 15 for air intake from outside into the inside of the ink container 13. The cartridge vessel also includes an air inlet duct 16 for introducing air taken in via opening 15 into the inside of the ink container 13, a reservoir 17 for transient storage of the ink 4 between the opening 15 and the air inlet duct 16, and a plural number of retention lugs 18 as well as a plural number of engagement steps 19 for retaining the ink cartridge 11 to the cartridge main 21.

The ink container 13 is formed of a material exhibiting high air-tightness and delimits a space in which to accommodate the ink 4. The ink container 13 is formed to approximately a rectangular shape of a longitudinal size approximately equal to the size along the width-wise direction W of the recording paper sheet P shown in FIG. 3.

The ink supply unit 14 is provided at a mid lower portion of the ink container 13. This ink supply unit 14 is a protuberantly-shaped nozzle communicating with and intruding into the ink container 13. The distal end of the nozzle is fitted in a connecting unit 26 of the head cartridge 2, as later explained, to connect the cartridge vessel 12 of the head cartridge 2 to the cartridge main 21 of the head cartridge 2.

Figure 4A:
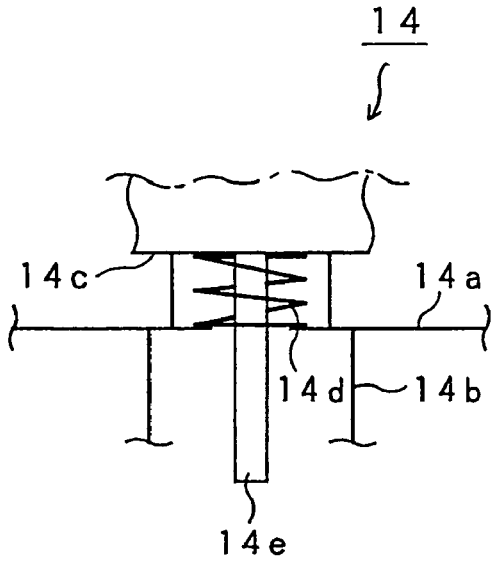
FIGS. 4A and 4B are schematic views illustrating an ink supply unit when an ink cartridge has been mounted to an ink jet print head cartridge, FIG. 4A showing the unit with a supply port closed and FIG. 4B showing the unit with the supply port opened.
Figure 4B:
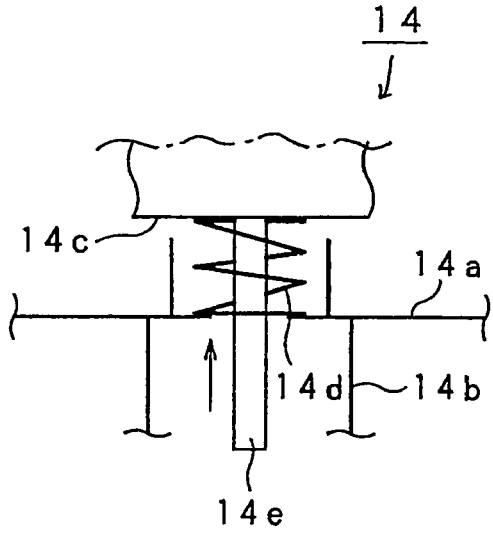

Referring to FIGS. 4A and 4B, the ink supply unit 14 is provided with a supply port 14*b* for supplying the ink 4 onto the bottom surface 14*a* of the ink cartridges 11. This bottom surface 14*a* is provided with a valve 14*c* for opening/closing a supply port 14*b*, a coil spring 14*d* for biasing the valve 14*c* in a direction of closing the supply port 14*b*, and an opening/closing pin 14*e* for opening/closing the valve 14*c*. The supply port 14*b*, connected to the connecting unit 26 of the head cartridge 2, for supplying the ink 4, is closed, in a stage prior to loading of the ink cartridge 11 on the cartridge main 21 of the head cartridge 2, by the valve 14*c* being biased in a direction of closing the supply port 14*b*, under the biasing force of the coil spring 14*d*, as a biasing member, as shown in FIG. 4A. When the ink cartridges 11 is loaded on the cartridge main 21, the opening/closing pin 14*e* is uplifted in an opposite direction to the biasing direction of the coil spring 14*d*, by an upper part of the connecting unit 26 of the cartridge main 21 constituting the head cartridge 2, as shown in FIG. 4B. The so uplifted opening/closing pin 14*e* uplifts the valve 14*c*, against the bias of the coil spring 14*d*, to open the supply port 14*b*. In this manner, the ink supply unit 14 of the ink cartridges 11 is connected to the connecting unit 26 of the head cartridge 2 to establish communication between the ink container 13 and an ink reservoir 31 to enable the ink 4 to be supplied to the ink reservoir 31.

When the ink cartridges 11 is extracted from the connecting unit 26 of the head cartridge 2, that is, when the ink cartridges 11 is dismounted from the mounting unit 22 of the head cartridge 2, the uplifting of the valve 14*c* by the opening/closing pin 14*e* is released, with the valve 14*c* being moved in the biasing direction of the coil spring 14*d* to close the supply port 14*b*. This prohibits the ink 4 in the ink container 13 from leaking even when the ink cartridges 11 is about to be loaded on the cartridge main 21 when the distal end of the ink supply unit 14 faces downwards. When the ink cartridges 11 is extracted from the cartridge main 21, the supply port 14*b* is closed quickly by the valve 14*c*, thereby prohibiting the ink 4 from leaking from the distal end of the ink supply unit 14.

Referring to FIG. 3, the opening for communication with outside 15 is an air communication opening for air intake from outside the ink cartridge 11 into the ink container 13. The opening 15 is provided in the upper surface, herein at a mid portion of the upper surface, of the cartridge vessel 12, where the opening faces outwards in order to take in air, so that, even when the ink cartridge is mounted on the mounting unit 22 of the head cartridge 2, the opening 15 faces outwards in order to take in air from outside. The opening 15 takes in air in an amount corresponding to the decreased quantity of the ink 4 in the ink container 13 when the ink cartridge 11 is mounted to the cartridge main 21 and the ink 4 has flown down from the ink container 13 towards the cartridge main 21.

The air inlet duct 16 provides for communication between the ink container 13 and the opening 15 to introduce air taken in from the port 15 into the ink container 13. Hence, when the ink cartridge 11 is mounted on the cartridge main 21 and the ink 4 is supplied into the inside of the cartridge main 21 of the head cartridge 2, with the quantity of the ink 4 in the ink container 13 then being decreased to lower the pressure inside the ink container, the inner pressure in the ink container 13 may be maintained in a balanced state due to air introduced into the ink container via air inlet duct 16 to enable the ink 4 to be adequately supplied into the inside of the cartridge main 21.

The reservoir 17 is provided between the opening for communication with outside 15 and the air inlet duct 16, and is used for transiently holding the ink 4 to prohibit the ink from flowing out precipitously when the ink 4 has leaked from the air inlet duct 16 communicating with the ink container 13. The reservoir 17 is substantially diamond-shaped in cross-section with the long diagonal line of the reservoir parallel to the longitudinal direction of the ink container 13. The air inlet duct 16 is provided at a lower apex point of the diamond shape of the ink container 13, that is, at the lowermost end of the short diagonal line of the reservoir, for restoring the ink 4 which has flown from the ink container 13 back into the ink container 13. Also, the opening for communication with outside 15 is provided at the lowermost apex on the short diagonal line of the reservoir 17 to render it difficult for the ink intruded from the ink container 13 to flow outwards via opening for communication with outside 15.

A plural number of retention lugs 18 are formed on one short lateral side of the ink cartridges 11, and are engaged with engagement openings 24*a* formed in a plural number of latch levers 24 of the cartridge main 21 of the head cartridge 2. Each retention lug 18 has its upper surface formed on a plane substantially perpendicular to the lateral surface of the ink container 13, while having its lower surface inclined from the lateral surface towards the aforementioned upper surface.

The engagement steps 19 are provided towards an upper end of the lateral surface of the ink cartridge 11 provided with the retention lugs 18. Each engagement step 19 is formed by an inclined surface 19*a*, having one end continuing to the upper surface of the cartridge vessel 12, and a planar surface 19*b*, continuing to the other end of the inclined surface 19*a* and to the opposite side lateral surface of the ink cartridge and extending parallel to the upper surface of the ink cartridge. Since the ink cartridge 11 is provided in this manner with the engagement steps 19, the height of the lateral surface of the ink cartridge, provided with the planar surfaces 19*b*, is lower by one step than the upper surface of the cartridge vessel 12, with the ink cartridge 11 engaging at these steps with a plural number of engagement pieces 23 of the cartridge main 21. The engagement steps 19 are provided on the lateral surface of the ink cartridge on the inserting side when the ink cartridge is inserted into the mounting unit 22 of the head cartridge 2. The engagement steps are engaged by the engagement pieces 23 of the mounting unit 22 of the head cartridge 2 to serve as a rotational fulcrum point when the ink cartridge 11 is to be mounted to the mounting unit 22.

The ink cartridge 11, designed and constructed as described above, includes a residual ink quantity sensor for detecting the residual quantity of the ink 4 in the ink container 13, and a discriminating unit for discriminating the ink cartridges 11*y*, 11*m*, 11*c* and 11*k*, in addition to the above-described components.

Next, the head cartridge 2, having loaded the ink cartridges 11*y*, 11*m*, 11*c* and 11*k*, in which are accommodated the inks 4 of yellow, magenta, cyan and black, respectively, will now be explained.

Figure 2:
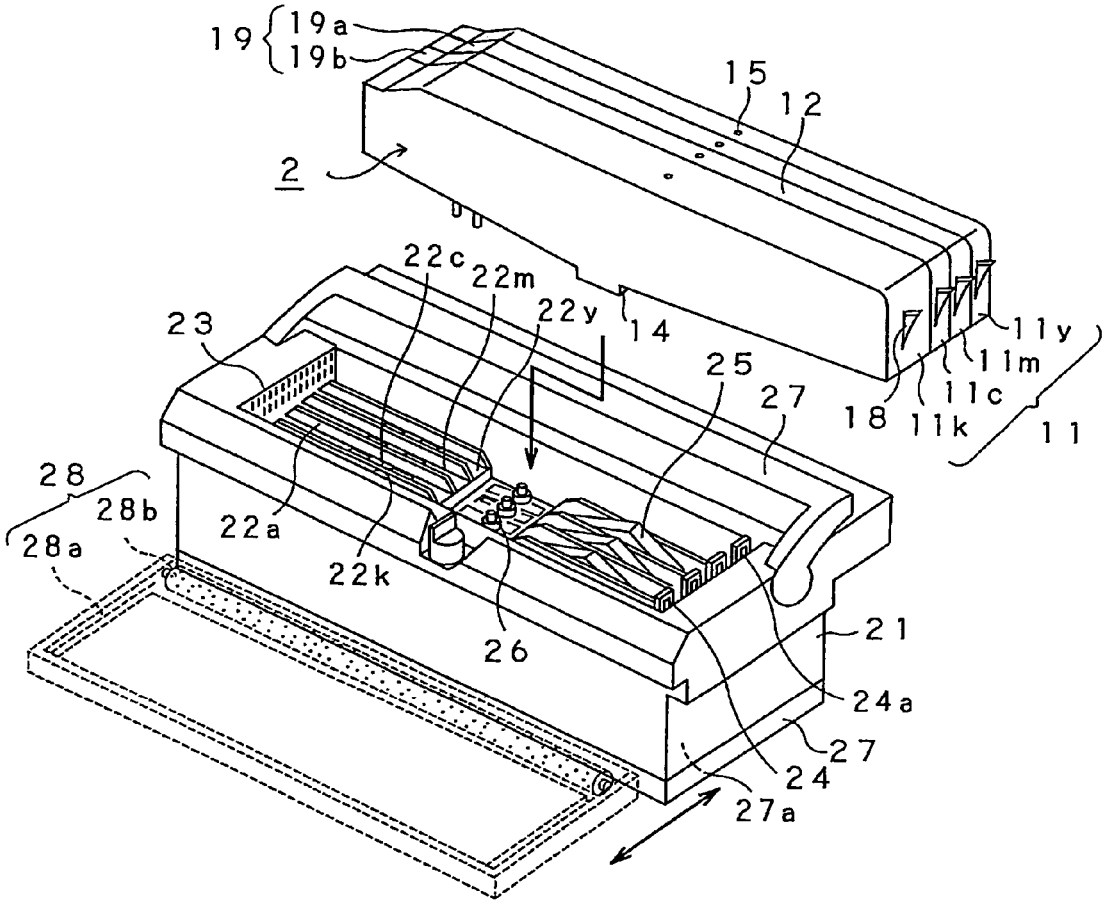
FIG. 2 is a perspective view showing an ink jet print head cartridge provided to the ink jet printer apparatus.

Referring to FIGS. 2 and 3, the head cartridge 2 is made up of the ink cartridge 11 and the cartridge main 21, as described above. The cartridge main 21 includes mounting units 22*y*, 22*m*, 22*c* and 22*k*, on which are mounted the ink cartridge 11. In the following, if these mounting units 22 are referred to collectively, they are simply depicted as mounting unit or units 22. The cartridge main also includes the engagement pieces 23 and the latch levers 24, for securing the ink cartridge 11, a biasing member 25 for biasing the ink cartridge 11 in the takeout direction, a connecting unit 26 connected to the ink supply units 14 so as to be supplied with the ink 4, an ink emitting head 27 for emitting the ink 4, and a head cap 28 for protecting the ink emitting head 27.

The upper surface of the mounting unit 22, on which are mounted the ink cartridge 11, is formed as a recessed portion used as a receiving/ejecting opening for the ink cartridge 11. Here, four ink cartridges 11 are accommodated side-by-side in the direction substantially perpendicular to the width-wise direction of the recording paper sheet P, that is, along the running direction of the recording paper sheet P. Since the mounting unit 22 receives the ink cartridges 11, it is arranged with its longitudinal side extending along the printing width, as are the ink cartridges 11. The ink cartridge 11 is accommodated and mounted in the cartridge main 21.

The mounting unit 22 is an area within which the ink cartridge 11 is mounted, as shown in FIG. 2. The mounting unit 22 includes a mounting unit 22*y*, within which the ink cartridge 11*y* for yellow is mounted, a mounting unit 22*m*, within which the ink cartridge 11*m* for magenta is mounted, a mounting unit 22*c*, within which the ink cartridge 11*c* for cyan is mounted, and a mounting unit 22*k*, within which the ink cartridge 11*k* for black is mounted. These mounting units 22*y*, 22*m*, 22*c* and 22*k* are delimited from one another by partitions 22*a*.

In general, the black ink cartridge 11*k* consumes much ink and is formed to a larger thickness to accommodate the ink 4 in a larger quantity. Hence, the black ink cartridge is wider in width than the other ink cartridges 11*y*, 11*m* and 11*k*, whilst the mounting unit 22*k* is wider in width than the other mounting units 22*y*, 22*m* or 22*c* in keeping with the thickness of the ink cartridge 11*k*.

In an opening end of the mounting unit 22, in which is mounted the ink cartridge 11, the engagement pieces 23 are formed, as shown in FIG. 3. These engagement pieces 23 are provided on the longitudinal lateral side of the mounting unit 22 and engaged with the engagement steps 19 of the ink cartridge 11.

The ink cartridge 11 may be mounted on the mounting unit 22 by obliquely introducing it into the mounting unit 22, with the engagement steps 19 of the ink cartridge 11 as a leading end, and by rotating the side of the ink cartridge 11 not having the engagement steps 19 towards the mounting unit 22, with the engaging locations of the engagement steps 19 and the engagement pieces 23 as the fulcrum point of rotation. By so doing, the ink cartridge 11 may easily be mounted on the mounting unit 22.

The latch levers 24 are each formed by warping a spring plate, as shown in FIG. 3. These latch levers are provided on the opposite lateral surface of the mounting unit 22 with respect to the engagement pieces 23 of the mounting unit 22, that is, on the opposite longitudinal lateral surface of the mounting unit. Each latch lever 24 has its proximal end mounted as one with the bottom side of the opposite lateral surface of the mounting unit 22, while having its distal end elastically movable in a direction towards and away from this lateral surface. An engagement recess 24*a* is formed towards the distal end of the latch lever.

The latch levers 24 are elastically deformed, at the same time as the ink cartridge 11 is mounted to the mounting unit 22, with the engagement recesses 24*a* engaging with the retention lugs 18 of the ink cartridge 11 for prohibiting the ink cartridge 11 mounted on the mounting unit 22 from being detached from the mounting unit 22.

The biasing member 25 is formed by bending a spring plate, mounted on a bottom surface towards the lateral side provided with the engagement steps 19 of the ink cartridge 11 for biasing the ink cartridge 11 in a direction of detaching the ink cartridge. The biasing member 25 has an apex point, formed by warping, and is elastically displaced in a direction towards and away from the bottom surface. The biasing member thrusts the bottom surface of the ink cartridge 11 at its apex point to bias the ink cartridge 11 in a direction of dismounting the ink cartridge from the mounting unit 22. The biasing member 25 ejects the ink cartridge 11 from the engagement pieces 23 when the retention lugs 18 are disengaged from engagement recesses 24*a* of the latch lever 24.

The connecting units 26, connected to the ink supply units 14 of the ink cartridges 11*y*, 11*m*, 11*c* and 11*k*, when the ink cartridges 11*y*, 11*m*, 11*c* and 11*k* are mounted in the mounting units 22*y*, 22*m* ,22*c* and 22*k*, are provided at mid portions in the longitudinal direction of the mounting units 22*y*, 22*m* ,22*c* and 22*k*. These connecting units 26 prove ink supply ducts for supplying the ink 4 to the ink emitting heads 27 provided to the bottom surface of the cartridge main 21 for emitting the ink 4 from the ink supply units 14 of the ink cartridges 11 mounted on the mounting units 22.

Figure 5:
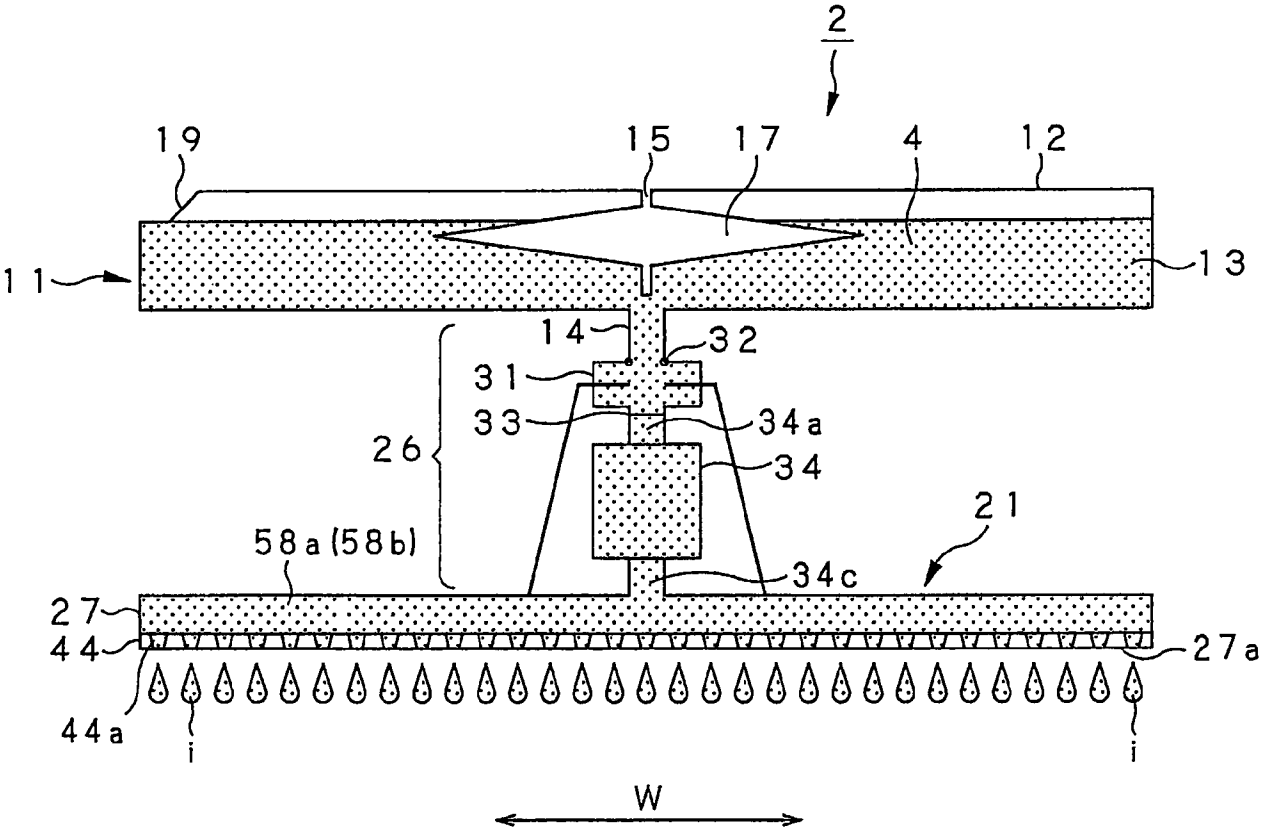
FIG. 5 is a schematic view for illustrating the relationship between the ink cartridge and the ink emitting head in the ink jet print head cartridge.

Specifically, the connecting units 26 are each provided with an ink reservoir 31, for holding the ink 4 supplied from the ink cartridge 11, a sealing member 32 for sealing the ink supply unit 14, connected to the connecting unit 26, a filter 33 for removing impurities in the ink 4, and a valving unit 34 for opening/closing the supply passage to the ink emitting head 27, as shown in FIG. 5.

The ink reservoir 31 is a space connecting to the ink supply unit 14 and adapted for storing the ink 4 supplied from the ink cartridge 11. The sealing member 32 is provided at an upper end of the ink reservoir 3 for hermetically sealing the space between the ink reservoir 31 and the ink supply unit 14 to prohibit the ink 4 from leaking to outside when the ink supply unit 14 is connected to the ink reservoir 31. The filter 33 removes impurities, such as dust and dirt, mixed into the ink 4 during loading/unloading of the ink cartridge 11, and is provided downstream of the ink reservoir 31.

Figure 6A:
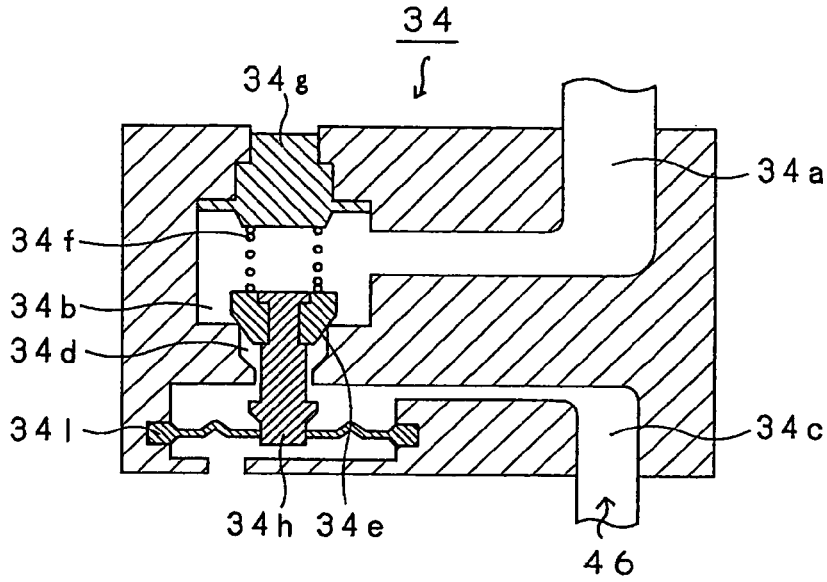
FIGS. 6A and 6B are cross-sectional views showing a valving unit in a connecting unit of an ink cartridge, with FIG. 6A showing the unit with a valve closed and FIG. 6B showing the unit with the valve opened.
Figure 6B:
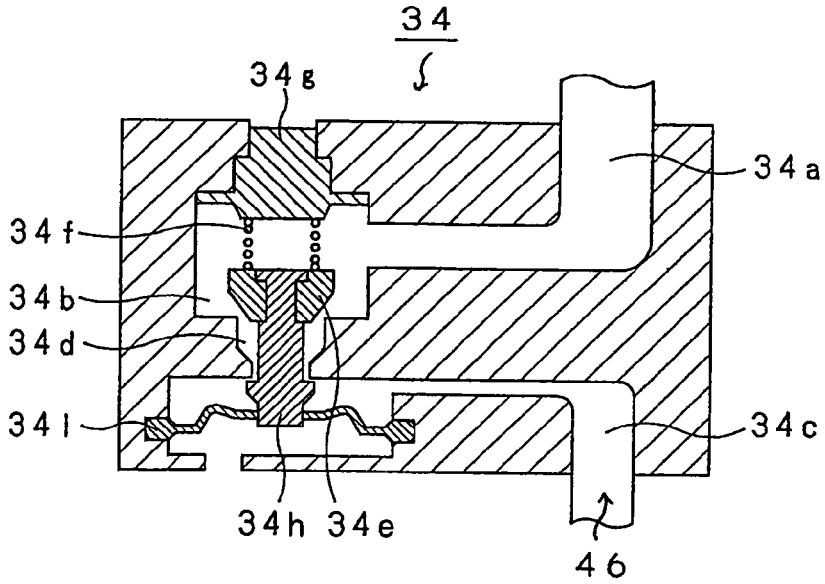

Referring to FIGS.6A and 6B, the valving unit 34 includes an ink inlet duct 34*a*, supplied with the ink 4 from the ink reservoir 31, an ink chamber 34*b*, supplied with the ink 4 from the ink inlet duct 34*a*, an ink outlet duct 34*c* for allowing the ink 4 to flow outwards from the ink chamber 34*b*, an opening 34*d* provided in the ink chamber 34*b* between the ink inlet duct 34*a* and the ink outlet duct 34*c*, a valve 34*e* for opening/closing the opening 34*d*, and a biasing member 34*f* for biasing the valve 34*e* in a direction of closing the opening 34*d*. The valving unit 34 also includes a negative pressure adjustment screw 34*g* for adjusting the force of biasing of the biasing member 34*f*, a valve shaft 34*h* connected to the valve 34*e*, and a diaphragm 34*i* connected to the valve shaft 34*h*.

The ink inlet duct 34*a* is a supply duct for connecting to the ink container 13 for supplying the ink 4 in the ink container 13 in the ink cartridge 11 via ink reservoir 31 to the ink emitting head 27. The ink inlet duct 34*a* is provided for extending from the bottom side of the ink reservoir 31 as far as the ink chamber 34*b*. The ink chamber 34*b* is a substantially rectangular space formed as one with the ink inlet duct 34*a*, ink outlet duct 34*c* and with the opening 34*d*. The ink 4 flows from the ink inlet duct 34*a* so as to be discharged via opening 34*d* from the ink outlet duct 34*c*. The ink outlet duct 34*c* is an ink supply duct in which the ink 4 is supplied from the ink chamber 34*b* via opening 34*d* and which is connected to the ink emitting head 27. The ink outlet duct 34*c* is extended from the bottom surface side of the ink chamber 34*b* as far as the ink emitting head 27.

The valve 34*e* is used for closing the opening 34*d* for separating the ink inlet duct 34*a* and the ink outlet duct 34*c* from each other, and is provided in the ink chamber 34*b*. The valve 34*e* is movable vertically under the biasing force of the biasing member 34*f*, the force of restoration of the diaphragm 34*i*, connected to the valve shaft 34*h*, and under the negative pressure of the ink 4 towards the ink outlet duct 34*c*. When in the lower position, the vale 34*e* closes the opening 34*d* for separating the ink chamber 34*b* into the ink inlet duct 34*a* and the ink outlet duct 34*c* for interrupting the supply of the ink 4 towards the ink outlet duct 34*c*. When in the upper end position, against the bias of the biasing member 34*f*, the valve 34*e* allows the ink 4 to be supplied to the ink emitting head 27 without interrupting the passage between the ink supply from the ink inlet duct 34*a* and the ink outlet duct 34*c* of the ink chamber 34*b*. Although there is no limitation to the material type of the valve 34*e*, it is formed of, for example, a caoutchouc material, or a so-called elastomeric material.

The biasing member 34*f* is, for example, a compression coil spring interconnecting the negative pressure adjustment screw 34*g* and the valve 34*e* between the upper surface of the valve 34*e* and the upper surface of the ink chamber 34*b* for biasing the valve 34*e* under its own biasing force in a direction of closing the opening 34*d* with the valve 34*e*. The negative pressure adjustment screw 34*g* is a screw for adjusting the biasing force of the biasing member 34*f* and the biasing force of the biasing member 34*f* may be adjusted by acting on the negative pressure adjustment screw 34*g*. Hence, with the negative pressure adjustment screw 34*g*, it is possible to adjust the negative pressure of the ink 4 actuating the valve 34*e* adapted for opening/closing the opening 34*d*, as will be explained subsequently in detail.

The valve shaft 34*h* is a shaft interconnecting the valve 34*e* connected at its one end and the diaphragm 34*i* connected at its other end for enabling the concerted movements of the valve and the diaphragm 34*i*. The diaphragm is a thin elastic sheet connected to the opposite end of the valve shaft 34*h*. This diaphragm 34*i* has one major surface facing the ink outlet duct 34*c* of the ink chamber 34*b* and the opposite major surface in contact with outside air, and is elastically displaced towards the outside air side or towards the ink outlet duct 34*c* under atmospheric pressure and under the negative pressure of the ink 4.

With the above-described valving unit 34, the valve 34*e* is thrust in a direction of closing the opening 34*d* of the ink chamber 34*b* under the force of bias exerted by the biasing member 34*f* and that exerted by the diaphragm 34*i*, as shown in FIG. 6A. When the ink 4 is emitted from the ink emitting head 27 to raise the negative pressure of the ink 4 in the portion of the ink chamber 34*b* towards the ink outlet duct 34*c*, partitioned by the opening 34*d*, the diaphragm 34*i* is uplifted by the atmospheric pressure, under the negative pressure of the ink 4, to uplift the valve 34*e*, along with the valve shaft 34*h*, against the biasing force of the biasing member 34*f*, as shown in FIG. 6B.

At this moment, the opening 34*d* between the side of the ink inlet duct 34*a* and the side of the ink outlet duct 34*c* of the ink chamber 34*b* is opened to permit the ink 4 to be supplied from the side of the ink inlet duct 34*a* into the side of the ink outlet duct 34*c*. The negative pressure of the ink 4 is lowered and the diaphragm 34*i* resumes its original shape by its own force of restoration, with the valve 34*e* being pulled down, along with the valve shaft 34*h*, under the force of bias of the biasing member 34*f*, for closing the ink chamber 34*b*. With the valving unit 34, the above-described movements are repeated each time the ink 4 is emitted such that the negative pressure of the ink 4 is raised.

With the connecting unit 26, when the ink 4 in the ink container 13 is supplied into the ink chamber 34*b*, the quantity of the ink 4 in the ink container 13 is decreased, however, at this moment, outside air is introduced from the air inlet duct 16 into the ink cartridge 11. The air introduced into the ink cartridge 11 is sent to an upper portion of the ink cartridge 11. This restores the state prior to emission of the ink droplet i from a nozzle 44*a*, which will be explained subsequently, so that a state of equilibrium is reached. The state of equilibrium is set up in a condition in which the ink 4 in the air inlet duct 16 is nearly depleted.

The ink emitting head 27 is arranged for extending along the bottom surface of the cartridge main 21, as shown in FIG. 5. A plural number of nozzles 44*a*, as ink emitting ports for emitting ink liquid droplets i, supplied from the connecting units 26, are arranged in a line, from one color to another, along the width-wise direction of the recording paper sheet P, that is, in the direction indicated by arrow W in FIG. 5.

The head cap 28 is a cover provided for protecting the ink emitting head 27 as shown in FIG. 2, and is dismounted from the ink emitting head 27 in carrying out the printing operation. The head cap 28 is provided with a groove 28*a*, provided in the opening/closing direction, and a cleaning roll 28*b*, extending longitudinally for sucking excess ink 4 deposited on an emitting surface 27*a* of the ink emitting head 27. The head cap 28 is opened/closed along this groove 28*a* in the transverse direction of the ink container 1. At this moment, the cleaning roll 28*b* is rotated, at it abuts against the emitting surface 27*a* of the ink emitting head 27 to suck up any excess ink 4 to clean the emitting surface 27*a* of the ink emitting head 27. The cleaning roll 28*b* is formed of, for example a highly hygroscopic material. When the printing apparatus is not in operation for printing, the head cap 28 protects the ink 4 in the ink emitting head 27 against drying.

The above-described head cartridge 2 includes a residual ink quantity detecting unit for detecting the residual quantity of the ink in the ink cartridge 11, and an ink presence/absence detecting unit for detecting the presence/absence of the ink 4, when the ink supply unit 14 is connected to the connecting unit 26, as an example, in addition to the above components.

Figure 7:
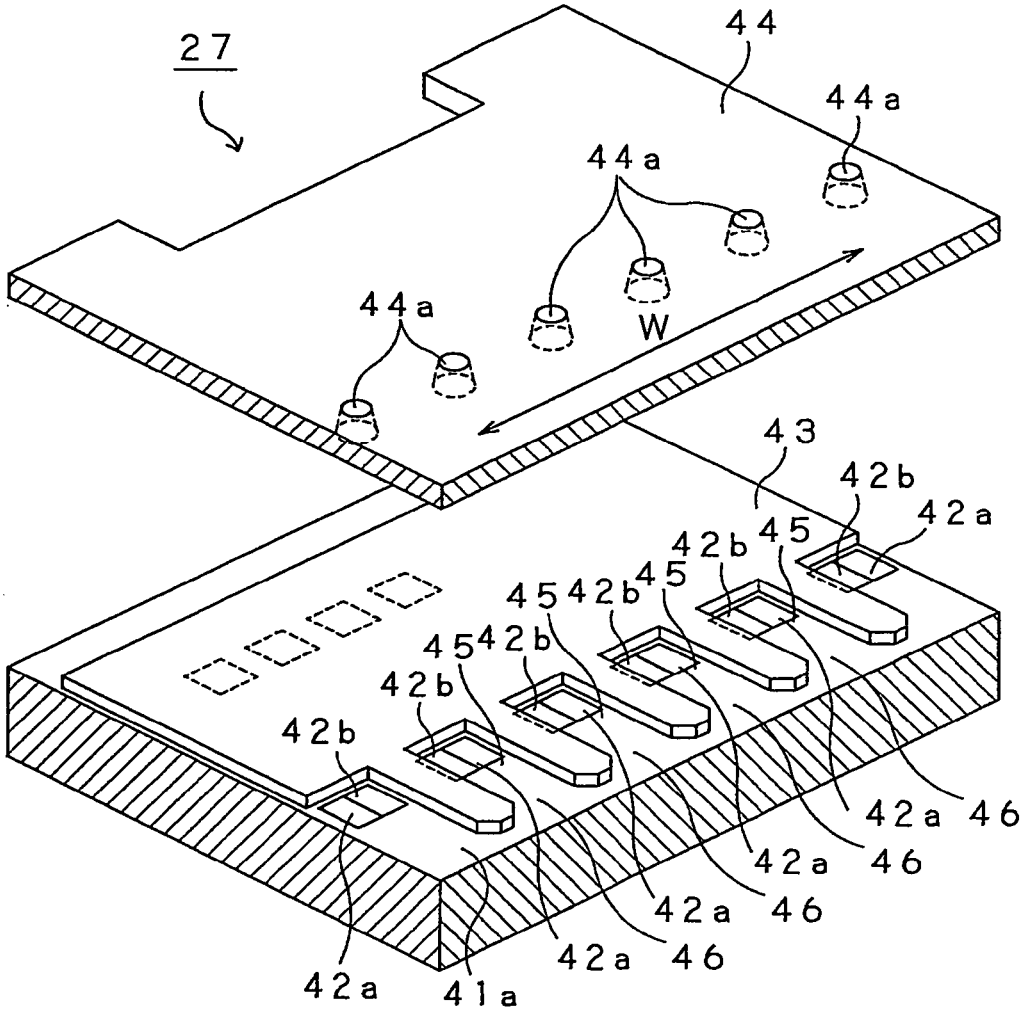
FIG. 7 is an exploded perspective view showing the ink emitting head of the ink jet print head cartridge.
Figure 8:
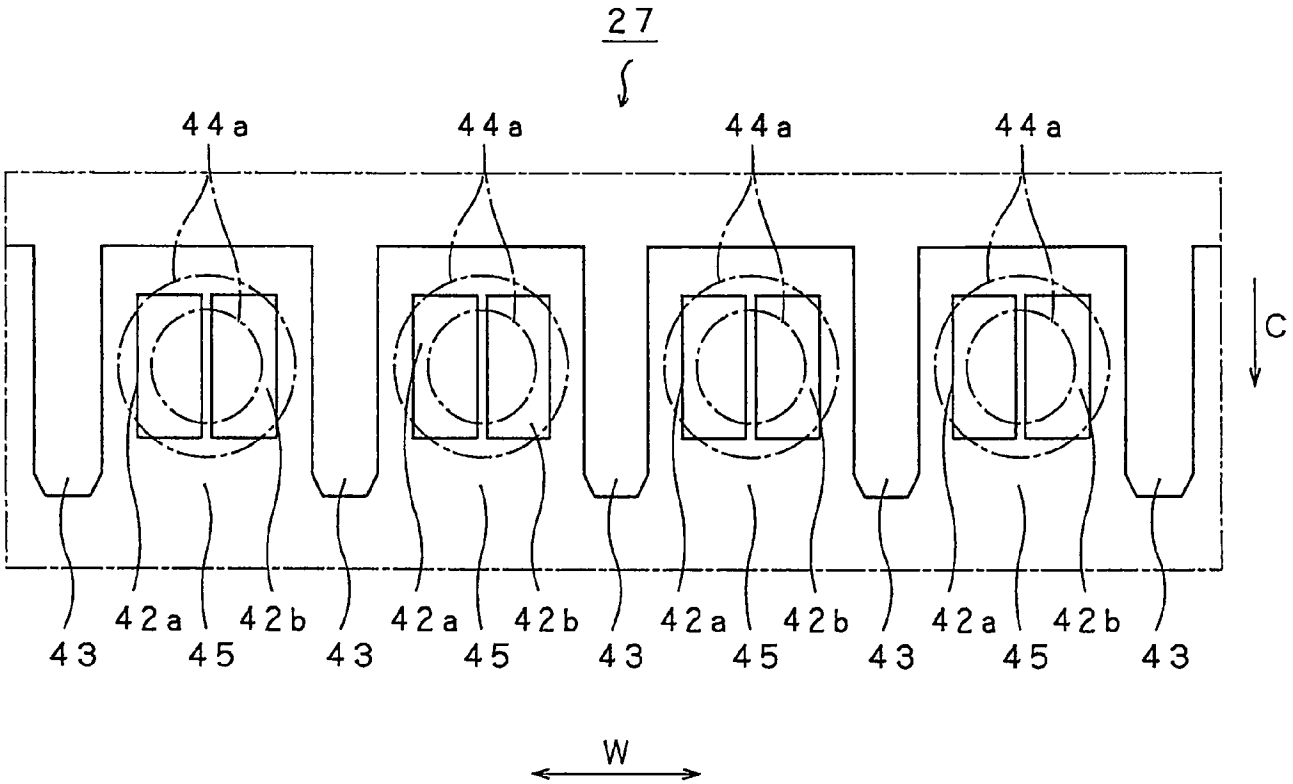
FIG. 8 is a plan view showing the ink emitting head.
Figure 9:
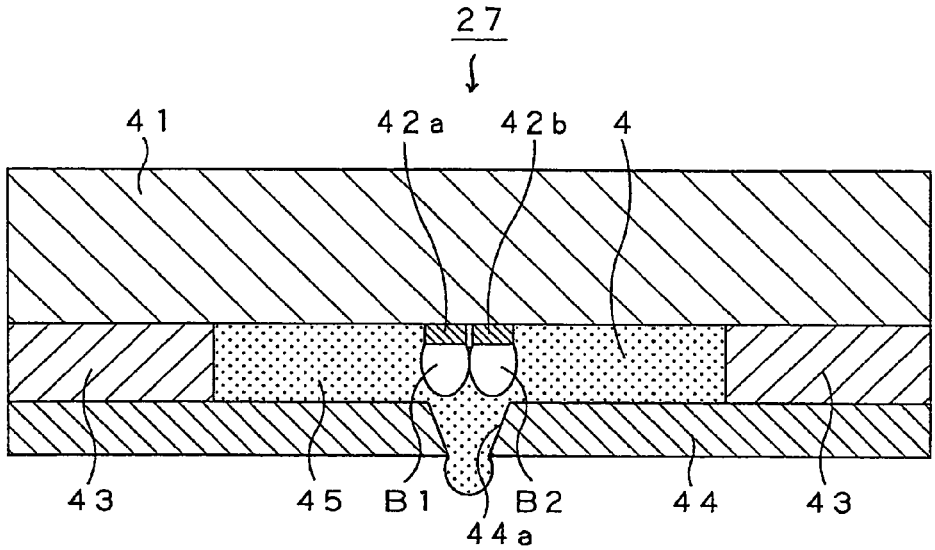
FIG. 9, illustrating the state of the ink emitting head emitting an ink droplet, is a cross-sectional view for showing the state in which ink air bubbles of approximately the same size have been formed in an ink liquid chamber.
Figure 10:
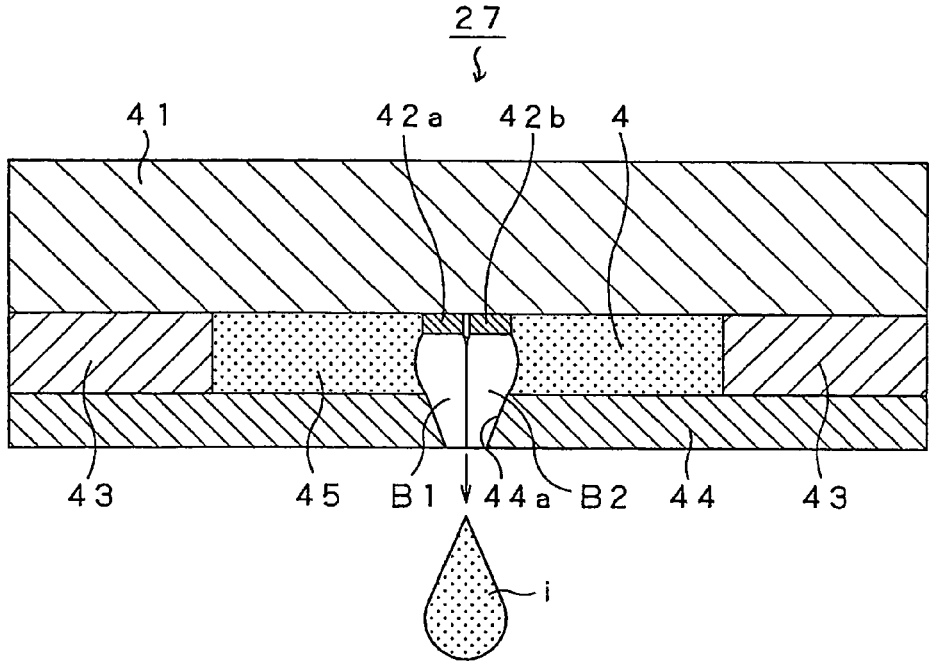
FIG. 10, illustrating the state of the ink emitting head emitting an ink droplet, is a cross-sectional view for showing the state in which an ink liquid droplet has been emitted vertically downward from the nozzle by two ink air bubbles.

Referring to FIGS.7 and 8, the ink emitting head 27 for each color ink 4 includes a circuit substrate 41, as a base, a pair of heating resistors 42*a*, 42*b*, arranged side-by-side in a direction substantially perpendicular to the running direction of the recording paper sheet P, that is, along the width-wise direction of the recording paper sheet P, a filter 43 for preventing leakage of the ink 4, and a nozzle sheet 44 having many nozzles 44*a* through which the ink 4 is emitted in the form of liquid droplets. The ink emitting head also includes ink liquid chambers 45, defining a space through which the ink 4 is supplied, and ink flow ducts 46 for supplying the ink 4 to the ink liquid chambers 45.

The circuit substrate 41 is a semiconductor substrate of, for example, silicon, and includes a pair of heating resistors 42*a*, 42*b* on its major surface 41*a*. These heating resistors 42*a*, 42*b* are connected to an emission controller 63, as later explained, provided on the circuit substrate 41. This emission controller 63 is an electronic circuit formed by e.g. a logic IC (integrated circuit) and a driver transistor.

The paired heating resistors 42*a*, 42*b* are pressure generating devices which are heated by the pulse current supplied from the emission controller 63 to heat the ink 4 in the ink liquid chambers 45 to raise the internal pressure. The ink 4, heated by these paired heating resistors 42*a*, 42*b*, is emitted as liquid droplets via nozzles 44*a* provided in the nozzle sheet 44 which will be explained subsequently.

The film 43 is formed on one major surface 41*a* of the circuit substrate 41. The film 43 is a dry film resist of, for example, the type hardened on light exposure. It is first formed on substantially the entire area of the major surface 41*a* of the circuit substrate 41 and subjected to a photolithographic process for removing unneeded portions. The film is formed for surrounding the paired heating resistors 42*a*, 42*b* in recessed portions. The portions of the film 43 surrounding the paired heating resistors 42*a*, 42*b* form part of the ink liquid chambers 45.

The nozzle sheet 44 is a sheet-like member, with a thickness on the order of 10 μm, provided with the nozzles 44*a* for emitting the ink droplets i, and is formed on the surface of the film 43 opposite to the circuit substrate 41. The nozzles 44*a* are openings of an extremely small diameter of the order of 15 to 18 μm, opened as circular holes in the nozzle sheet 44. The nozzles 44*a* are arranged facing the paired heating resistors 42*a*, 42*b*. The nozzle sheet 44 forms a part of the ink liquid chambers 45.

The ink liquid chambers 45 are each an area surrounded by the circuit substrate 41, paired heating resistors 42*a*, 42*b*, film 43 and the nozzle sheet 44 for storage of the ink 4 supplied from the ink flow duct 46. Each ink liquid chamber forms a space in which is stored the ink 4 supplied from the-ink flow duct 46. The ink liquid chamber 45 is heated by the paired heating resistors 42*a*, 42*b* whereby the inner pressure in the ink liquid chambers 45 is raised.

The ink flow duct 46 is connected to the ink outlet duct 34*c* of the connecting unit 26, and is supplied with the ink 4 from the ink cartridge 11 connected to the connecting unit 26. The ink flow duct forms a flow passage for delivery of the ink 4 to each ink liquid chamber 45 communicating with the ink flow duct 46. That is, the ink flow duct 46 communicates with the connecting unit 26. Hence, the ink 4 supplied from the ink cartridge 11 flows into the ink flow duct 46 so as to be charged into the ink liquid chamber 45.

The aforementioned sole ink emitting head 27 includes 100 to 5000 ink liquid chambers 45 for each color ink cartridge 11 provided with the paired heating resistors 42*a*, 42*b*. The paired heating resistors 42*a*, 42*b* are provided to each ink liquid chamber 45. In the ink emitting head 27, the paired heating resistors 42*a*, 42*b* are selected and generate heat under a command from a controller 68 of the printer apparatus 1. The ink 4 contained in the ink liquid chamber 45, associated with the heated paired heating resistors 42*a*, 42*b*, is emitted as liquid droplets from the nozzle 44*a* associated with the ink liquid chamber 45.

That is, in the ink emitting head 27, the ink 4 supplied from the ink flow duct 46 coupled to the ink emitting head 27, is charged into the ink liquid chamber 45. The pulse current is caused to flow through the paired heating resistors 42*a*, 42*b* for a short time, for example, for 1 to 3 μsec, for quickly heating the paired heating resistors 42*a*, 42*b*, as a result of which the portion of the ink 4 in contact with the paired heating resistors 42*a*, 42*b* is heated to generate ink bubbles in the gaseous phase, and a certain volume of the ink 4 is pressurized by the expansion of the ink air bubbles (ebullition of ink 4). Thus, the ink 4 in contact with the nozzle 44*a* is emitted in a quantity equivalent to the volume of the ink 4, pressurized by the expanded ink air bubbles, so as to be deposited as ink liquid droplet i on the recording paper sheet P.

In this ink emitting head 27, the paired heating resistors 42*a*, 42*b* are arranged side-by-side, approximately parallel to each other, in the sole ink liquid chamber 45, as shown in FIG. 8. That is, the paired heating resistors 42*a*, 42*b* are provided in the sole ink liquid chamber 45. In the ink emitting head 27, a plural number of the paired heating resistors 42*a*, 42*b*, arranged parallel to each other, are arranged side-by-side in the direction substantially orthogonal to the running direction of the recording paper sheet P, indicated by arrow C in FIG. 8, that is, in the width-wise direction of the recording paper sheet P, as indicated by arrow W in FIG. 8. Meanwhile, the location of the nozzle 44*a* is indicated by a chain-dotted line in FIG. 8.

The paired heating resistors 42*a*, 42*b* are each a division in two of a sole resistor, with the length being the same and the width being halved, so that the resistance value of each resistor is approximately doubled. If the resistors of the paired heating resistors 42*a*, 42*b* are connected in series, two resistors each having the resistance value doubled, are connected in series, so that the resistance value is four times that prior to division.

For ebullition of the ink 4 in the ink liquid chamber 45, it is necessary to heat the paired heating resistors 42*a*, 42*b* by applying a constant pulse current to the paired heating resistors 42*a*, 42*b*, so that the ink droplets i will be emitted by the energy generated by ebullition. If the resistance value is small, it is necessary to increase the pulse current caused to flow. Since resistance value of the paired heating resistors 42*a*, 42*b*, equivalent to a sole resistor divided in two portions, is higher than that of the undivided sole resistor, it is possible to produce ebullition with the pulse current of a small current value.

In this manner, in the ink emitting head 27, e.g. transistors, through which the pulse current is caused to flow, may be of a small size to save space. Although the resistance value may further be raised by reducing the thickness of the paired heating resistors 42*a*, 42*b*, there is a certain limit imposed on reducing the thickness of the paired heating resistors 42*a*, 42*b*, from the perspective of the material selected for the paired heating resistors 42*a*, 42*b*, strength or durability. For this reason, the resistance value of the paired heating resistors 42*a*, 42*b* is increased by dividing the sole resistor in two, instead of by reducing their thicknesses.

It should be noted that, in emitting the ink in the ink liquid chamber 45 through the nozzle 44*a*, the ink droplet i may be emitted vertically downward from the nozzle 44*a* by driving controlling the paired heating resistors 42*a*, 42*b* so that the time until ebullition of the ink in the ink liquid chamber 45 by the paired heating resistors 42*a*, 42*b*, that is, the time duration for air bubble generation, will be the same for the paired heating resistors.

If time difference is produced in the air bubble generation time duration of the paired heating resistors 42*a*, 42*b*, it becomes difficult to generate ink bubbles at about the same time by the paired heating resistors 42*a*, 42*b*, with the result that the ink droplets are emitted with an offset towards one of the arraying directions of the paired heating resistors 42*a*, 42*b*.

Specifically, the ink 4 is supplied by the ink flow duct 46, coupled to the ink emitting head 27, so that the ink 4 is charged in the ink liquid chamber 45, as shown in FIG. 7.

Hence, gaseous ink air bubbles B1 and B2 are generated in the portions of the ink 4 contacting with the paired heating resistors 42*a*, 42*b* so that each preset volume of the ink 4 is pressurized by expansion of the ink bubbles B1 and B2. Consequently, the ink 4 of the same quantity as the volume of the ink 4, pressured vertically downward by each of the ink bubbles B1 and B2 towards the recording paper sheet P in the portion of the ink emitting head 27 contacted with the nozzle 44*a*, is emitted directly downward from the nozzle 44*a* as an ink droplet i, so as to be deposited on the recording paper sheet P.

Figure 11:
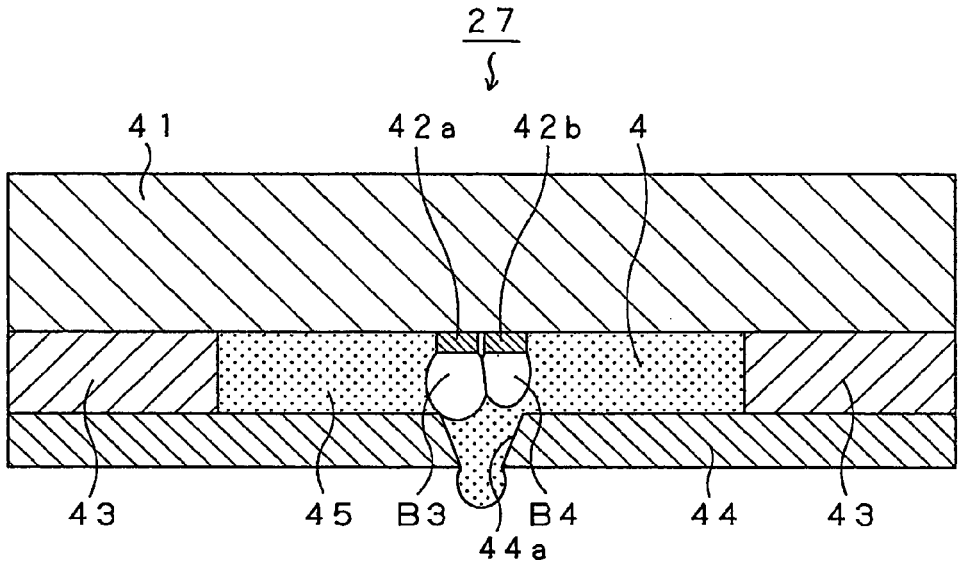
FIG. 11, illustrating the state of the ink emitting head emitting an ink liquid droplet, is a cross-sectional view for showing the state in which ink air bubbles of differing sizes have been formed in the ink liquid chamber.

If, in the ink emitting head 27, pulse currents of respective different values are supplied substantially simultaneously to the paired heating resistors 42*a*, 42*b*, ink air bubbles B3, B4 of respective different sizes are generated in the portions of the ink 4 contacted with the paired heating resistors 42*a*, 42*b*, as shown in FIG. 11. Hence, the ink of a preset volume is pressurized by the expansion of these ink air bubbles B3 and B4.

Figure 12:
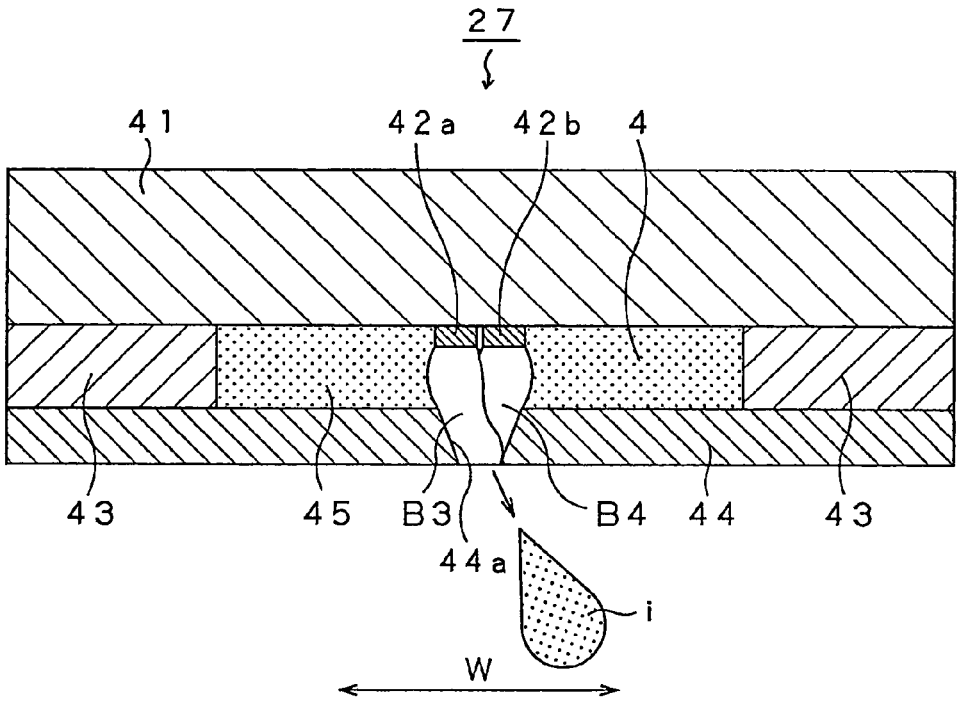
FIG. 12, illustrating the state of the ink emitting head emitting an ink droplet, is a cross-sectional view for showing the state in which an ink liquid droplet has been emitted in a substantially oblique direction from the nozzle by two ink air bubbles.

Moreover, in the ink emitting head 27, a quantity of the ink 4 equivalent to the volume of the ink 4 pressured by the ink bubbles B3 and B4 in the portion of the ink contacted with the nozzle 44*a* is emitted as ink droplets i from the nozzle 44*a*, with an offset towards one of the ink bubbles B3 and B4 which is of a smaller volume, along the width-wise direction of the recording paper sheet P, indicated by arrow W in FIG. 12, so as to be deposited on the recording paper sheet P, as shown in FIG. 12.

When pulse currents with different values are supplied to the paired heating resistors 42*a*, 42*b*, in the ink emitting head 27, the pulse current supplied to one of the paired heating resistors 42*a*, 42*b* is used as a reference, and the pulse current having the current value difference within 10% of the reference current is supplied to the other of the paired heating resistors. By so doing, the current value difference of the pulse currents supplied to the paired heating resistors 42*a*, 42*b* in the ink emitting head 27 may become optimum. Hence, there is no risk that the size of the ink bubbles B3 and B4 formed on the paired heating resistors 42*a*, 42*b* becomes excessively unbalanced to destabilize the pressurized state of the ink 4 to cause fluctuations in the emitting directions of the ink droplets i.

Furthermore, with the ink emitting head 27, the current value difference of the pulse currents, supplied to the paired heating resistors 42*a*, 42*b*, may be optimized, such that there is no risk that the angle of emission between the emitting surface 27*a* and the emitting direction becomes too small to cause the emitted ink droplet i to be contacted with the edge of the nozzle 44*a*. Hence, it becomes possible to prevent fluctuations of the emitting directions of the ink droplets i.

The printer main 3, constituting the printer apparatus 1, on which is mounted the head cartridge 2, formed as described above, will now be explained with reference to the drawings.

Figure 13:
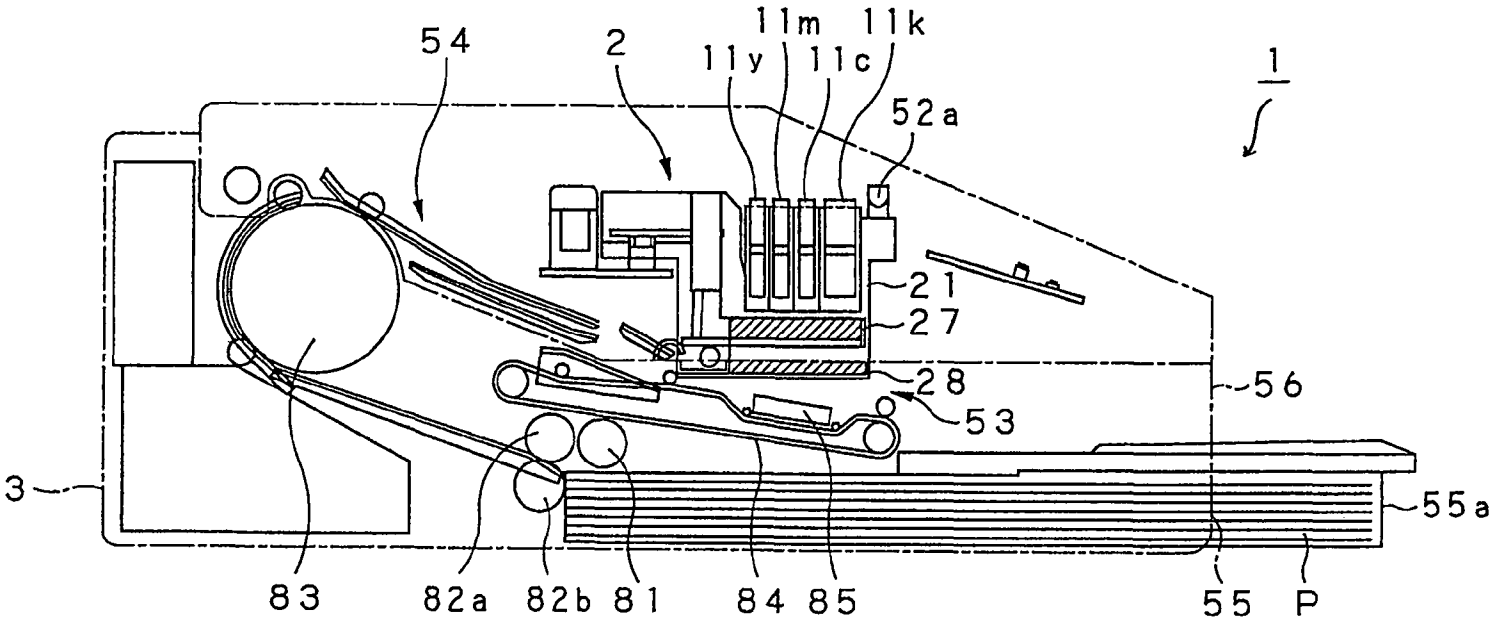
FIG. 13 is a side view of an ink jet printer apparatus, with a portion thereof being shown in a see-through fashion.

Referring to FIGS. 1 and 13, the printer main 3 includes a head cartridge mounting unit 51, on which is loaded the head cartridge 2, a head cartridge holding unit 52 for holding and securing the head cartridge 2 to the head cartridge mounting unit 51, a head cap opening/closing unit 53, for opening/closing the head cap, and a paper sheet feed/discharge unit 54, for supplying and discharging the recording paper sheet P. The printer main 3 also includes a paper sheet feed port 55 for supplying the recording paper sheet P to the paper sheet feed/discharge unit 54, and a paper sheet discharge port 56 for outputting the recording paper sheet P from the paper sheet feed/discharge unit 54.

The head cartridge mounting unit 51 is a recess within which is mounted the head cartridge 2. The head cartridge 2 is mounted so that, for printing data correctly on the running paper sheet, the emitting surface 27*a* of the ink emitting head 27 will be substantially parallel to the plane of the recording paper sheet P.

There are occasions wherein the head cartridge 2 needs to be replaced by e.g. ink stopping up the ink emitting head 27. Hence, the head cartridge 2 is a consumable item, although it is not to be exchanged so often as the ink cartridge 11. Hence, the head cartridge is held by the head cartridge holding unit 52 so as to be dismounted as desired from the head cartridge mounting unit 51.

The head cartridge holding unit 52 is a unit which detachably holds the head cartridge 2 with respect to the head cartridge mounting unit 51. A knob 52*a* provided to the head cartridge 2 is retained by a biasing member, such as a spring, not shown, provided in a retention opening 52*b* of the printer main 3. This fits the head cartridge 2 by pressure fit against a reference plane 3*a* provided to the printer main 3, thereby positioning and fixing the head cartridge 2.

The head cap opening/closing unit 53 includes a driving unit for opening/closing the head cap 28 of the head cartridge 2. For printing, the head cap 28 is opened for exposing the ink emitting head 27 to the recording paper sheet P and, when the printing has come to a close, the head cap 28 is closed to protect the ink emitting head 27.

The paper sheet feed/discharge unit 54 includes a driving unit for transporting the recording paper sheet P. The driving unit transports the recording paper sheet P, supplied from the paper sheet feed port 55, to the ink emitting head 27 of the head cartridge 2, while transporting the printed paper sheet P, with the ink droplets i, emitted from the nozzle 44*a* and deposited thereon, to the paper sheet discharge port 56 to discharge it to outside the apparatus.

The paper sheet feed port 55 is an opening for feeding the recording paper sheet P to the paper sheet feed/discharge unit 54, and is able to hold a stack of plural recording paper sheets P on e.g. a tray 55*a*. The paper sheet discharge port 56 is an opening via which is discharged the recording paper sheet P on which the ink droplets i have become deposited to finish the printing.

A control circuit 61, controlling the printing by the printer apparatus 1, constructed as described above, will now be explained with reference to the drawings.

The control circuit 61 includes a printer driver 62, for driving controlling the units 53 and 54 of the printer main 3, an emission controller 63 for controlling e.g. the current supplied to the ink emitting head 27 associated with the inks 4 of different colors, and an alerting unit 64 for alerting the residual quantity of the inks 4 of different colors. The control circuit also includes an input/output terminal 65 for inputting/outputting signals for an external device, and a ROM (read-only memory) 66 having recorded e.g. a control program. The control circuit further includes a RAM (random-access memory) 67 transiently storing e.g. a control program as read out as necessary, and a controller 68 for controlling various parts.

The printer driver 62 controls the head cap opening/closing unit for opening/closing the head cap 28 by actuating a driving motor constituting the head cap opening/closing unit 53 based on the control signal from the controller 68.

The printer driver 62 also actuates a driving motor, constituting the paper sheet feed/discharge unit 54, based on a control signal from the controller 68, to feed the recording paper sheet P from the paper sheet feed port 55 of the printer main 3, to discharge the paper sheet P from the paper sheet discharge port 56.

Figure 15:
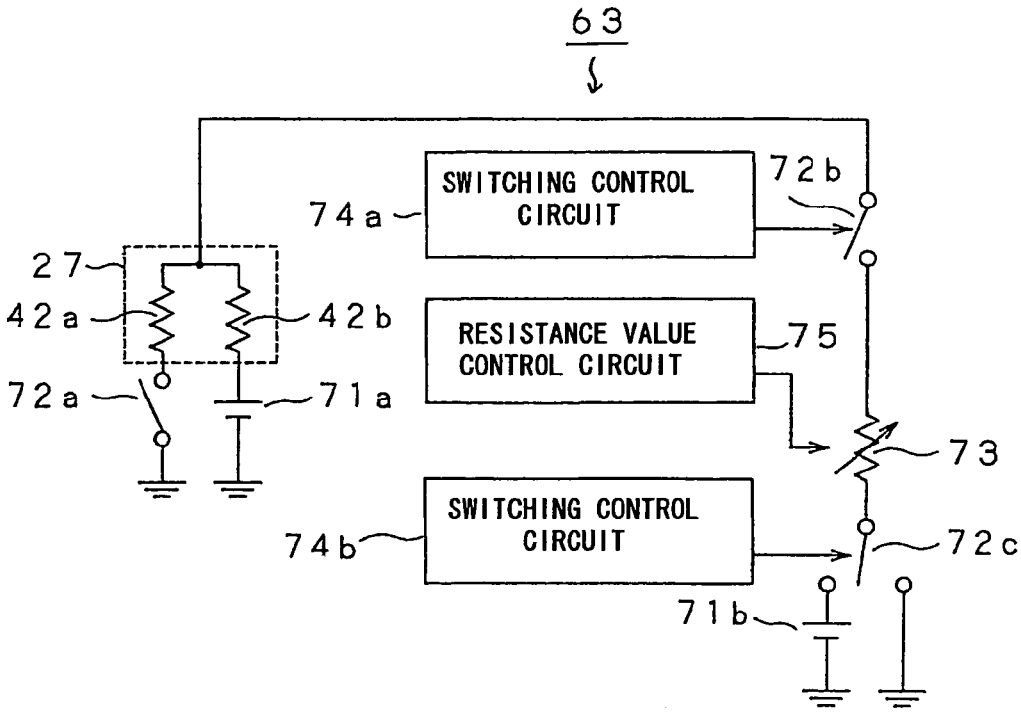
FIG. 15 is a schematic block diagram showing an emission control unit of a control circuit.

Referring to FIG. 15, the emission controller 63 is an electrical circuit including power sources 71*a*, 71*b* for supplying pulse current to the paired heating resistors 42*a*, 42*b*, which are resistor elements, switch devices 72*a* to 72*c*, for turning the electrical connection between the paired heating resistors 42*a*, 42*b* and the power sources 71*a*, 71*b* on or off, a variable resistor 73 for controlling the pulse currents supplied to the paired heating resistors 42*a*, 42*b*, switching control circuits 74*a*, 74*b* for controlling the switching of the switch devices 72*b* and 72*c*, and a resistance value control circuit 75 for controlling the resistance value of the variable resistor 73.

The power source 71*a* is connected to the heating resistor 42*b*, while the power source 71*b* is connected via switch device 72*c* to the variable resistor 73. Both the power sources supply the pulse current to the electrical circuit. Meanwhile, although the pulse current supplied to the electrical circuit may be supplied from the power sources 71*a*, 71*b*, the pulse current may also be directly supplied from for example the controller 68.

The switch device 72*a* is arranged between the paired heating resistor 42*a* and the ground to control the on/off of the emission controller 63 in its entirety. The switch device 72*b* is connected between the paired heating resistors 42*a*, 42*b* and the variable resistor 73 to control the pulse current supplied to the paired heating resistors 42*a*, 42*b*.

The switch device 72*c* is arranged between the variable resistor 73 and the power source 71*b* to control the direction of emission of the ink droplet i. These switch devices 72*a* to 72*c* are on/off controlled to control the pulse current supplied to the electrical circuit.

The variable resistor 73 varies its own resistance value to change the current value of the pulse current supplied to the heating resistor 42*a*. That is, the current value of the pulse current, supplied to the heating resistor 42*a*, is determined by the magnitude of the resistance of the variable resistor 73.

The switching control circuit 74*a* changes over the on/off of the switch device 72*b* to connect the variable resistor 73 to the paired heating resistors 42*a*, 42*b* or turns off the variable resistor 73 and the paired heating resistors 42*a*, 42*b*. The switching control circuit 74*b* changes over the on/off of the switch device 72*c* to change over the on/off of the electrical connection between the power source 71*b* and the electrical circuit.

The resistance value control circuit 75 controls the magnitude of the resistance value of the variable resistor 73 to adjust the value of the pulse current supplied to the heating resistor 42*a*.

If, in the above-described emission controller 63, the switch device 72*b* is turned off, with there being no electrical connection between the variable resistor 73 and the paired heating resistors 42*a*, 42*b*, and the switch device 72*a* is turned on, the pulse current is supplied from the power source 71*a* to the series-connected paired heating resistors 42*a*, 42*b*. At this moment, no current flows through the variable resistor 73.

If the resistance values of the paired heating resistors 42*a*, 42*b* are approximately equal to each other, the heat values generated by the paired heating resistors 42*a*, 42*b* when the pulse current is supplied thereto, is approximately equal to each other.

Figure 16A:
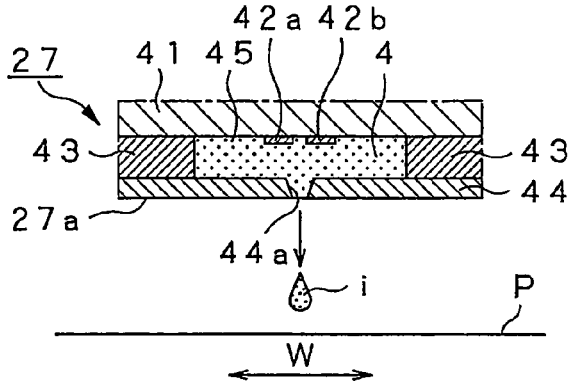
FIGS. 16A to 16C are cross-sectional views showing the state of the emission control unit controlling the emitting direction of the ink liquid droplets, with FIG. 16A schematically showing the state of emission of an ink droplet in a directly downward direction, FIG. 16B schematically showing the state of emission of ink liquid droplets in one of oblique directions along the width of the recording paper sheet with the nozzle as center, and FIG. 16C schematically showing the state of emission of ink liquid droplets in the other oblique direction along the width of the recording paper sheet with the nozzle as center.

In this case, the heat values generated in the paired heating resistors 42*a*, 42*b* in the ink emitting head 27 become approximately equal to each other, and the time durations of air bubbles become approximately equal to each other. Hence, the angle of emission of the ink 4 is approximately orthogonal to the major surface of the recording paper sheet P, with the ink droplet i being emitted from the nozzle 44*a* substantially directly downward, as shown in FIG. 16A.

Figure 16B:
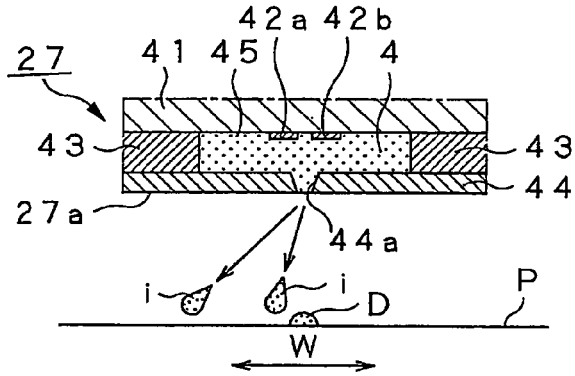

In the emission controller 63, shown in FIG. 15, in case the switch device 72*b* has turned on the electrical connection between the paired heating resistors 42*a*, 42*b* and the variable resistor 73, the switch device 72*a* is turned on, and the switch device 72*c* is connected to the ground, the ink droplet i, emitted from the ink emitting head 27, is emitted as the emitting direction is offset towards the heating resistor 42*a* along the width-wise direction W of the recording paper sheet P, as shown in FIG. 16B. That is, since the switch device 72*c* is connected to the ground, the current value of the pulse current supplied to the heating resistor 42*a* becomes smaller in proportion to the resistance value of the variable resistor 73. This produces the difference in the pulse currents supplied to the paired heating resistors 42*a*, 42*b*, arranged side-by-side substantially parallel to the width-wise direction of the recording paper sheet P, thus also producing the difference in the heat value generated in the two resistors. In this emission controller 63, the current value of the pulse current supplied to the heating resistor 42*b* remains unchanged, and only the current value of the pulse current supplied to the heating resistor 42*a* is changed.

If, in this case, the resistance value of the variable resistor 73 is high, the current flowing from the power source 71*a* through the switch device 72*c* to the ground becomes small and the decrease of the current value of the pulse current supplied from the power source 71 *a* to the heating resistor 42*a* is small. Consequently, the difference in the pulse currents supplied to the paired heating resistors 42*a*, 42*b* becomes small and the difference in the heat values generated in the paired heating resistors 42*a*, 42*b* also becomes small, with the angle of emission of the ink droplet i from the nozzle 44*a*, with the emitting surface 27*a* as the reference, becoming larger. That is, the ink droplet i is emitted so that, the higher the resistance value of the variable resistor 73, the closer on the side of the heating resistor 42*a* becomes the position of deposition of the ink droplet i to a point of deposition D of the ink droplet i emitted vertically downward from the nozzle 44*a*.

If conversely the resistance value of the variable resistor 73 is low, the current flowing from the power source 71*a* through the switch device 72*c* to the ground becomes large and the decrease of the current value of the pulse current supplied from the power source 71*a* to the heating resistor 42*a* is increased. Consequently, the difference in the pulse currents supplied to the paired heating resistors 42*a*, 42*b* becomes larger and the difference in the heat values generated in the paired heating resistors 42*a*, 42*b* also becomes larger, with the angle of emission of the ink droplet i from the nozzle 44*a*, with the emitting surface 27*a* as the reference, becoming smaller. That is, the ink droplet i is emitted so that, the lower the resistance value of the variable resistor 73, the remoter on the side of the heating resistor 42*a* becomes the position of deposition of the ink droplet i from the point of deposition D of the ink droplet i emitted vertically downward from the nozzle 44*a*.

Figure 16C:
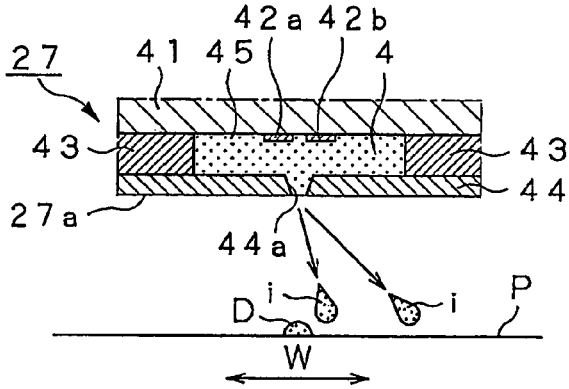

Also, in the emission controller 63, shown in FIG. 15, in case the switch device 72*b* has turned on the electrical connection between the paired heating resistors 42*a*, 42*b* and the variable resistor 73, the switch device 72*a* is turned on and the switch device 72*c* is connected to the power source 71*b*, the ink droplet i, emitted from the ink emitting head 27, is emitted as the emitting direction is offset, as shown in FIG. 16C, towards the heating resistor 42*b* along the width-wise direction W of the recording paper sheet P, indicated in FIG. 16C. That is, since the switch device 72*c* is connected to the power source 71*b*, the current value of the pulse current supplied to the heating resistor 42*a* becomes larger in proportion to the resistance value of the variable resistor 73. This produces the difference in the power supplied to the paired heating resistors 42*a*, 42*b*, arranged side-by-side substantially parallel to the width-wise direction of the recording paper sheet P, thus also producing the difference in the heat values generated in the two resistors.

In the ink emitting head 27, the heating state of the heating resistors 42*a*, 42*b* is reversed from that in case the switch device 72*c* is connected to ground.

If, in this case, the resistance value of the variable resistor 73 is high, the current supplied to the heating resistor 42*a* by the power source 71*b* in addition to the current supplied by the power source 71*a* becomes smaller, and hence the difference in the pulse currents supplied to the paired heating resistors 42*a*, 42*b* becomes smaller. Consequently, the difference in the heat values generated in the paired heating resistors 42*a*, 42*b* also becomes smaller, with the angle of emission of the ink droplet i from the nozzle 44*a*, with the emitting surface 27*a* as the reference, becoming larger.

That is, the ink droplet i is emitted so that, the higher the resistance value of the variable resistor 73, the closer on the side of the heating resistor 42*b* becomes the position of deposition of the ink droplet i to the point of deposition D of the ink droplet i emitted vertically downward from the nozzle 44*a*.

If conversely the resistance value of the variable resistor 73 is low, the current supplied to the heating resistor 42*a* by the power source 71*b* in addition to the current supplied by the power source 71*a* becomes larger, and hence the difference in the pulse currents supplied to the paired heating resistors 42*a*, 42*b* becomes larger. Consequently, the difference in the heat values generated in the paired heating resistors 42*a*, 42*b* also becomes larger, with the angle of emission of the ink droplet i from the nozzle 44*a*, with the emitting surface 27*a* as the reference, becoming smaller. That is, the ink droplet i is emitted so that, the lower the resistance value of the variable resistor 73, the remoter on the side of the heating resistor 42*b* becomes the position of deposition of the ink droplet i from the point of deposition D of the ink droplet i emitted vertically downward from the nozzle 44*a*.

Thus, in the emission controller 63, by changing over the switch devices 72*a* to 72*c* and varying the resistance value of the variable resistor 73, the direction of emission of the ink droplet i from the nozzle 44*a* may be changed along the direction of the juxtaposition of the paired heating resistors 42*a*, 42*b*, that is, along the width-wise direction of the recording paper sheet P.

Figure 17:
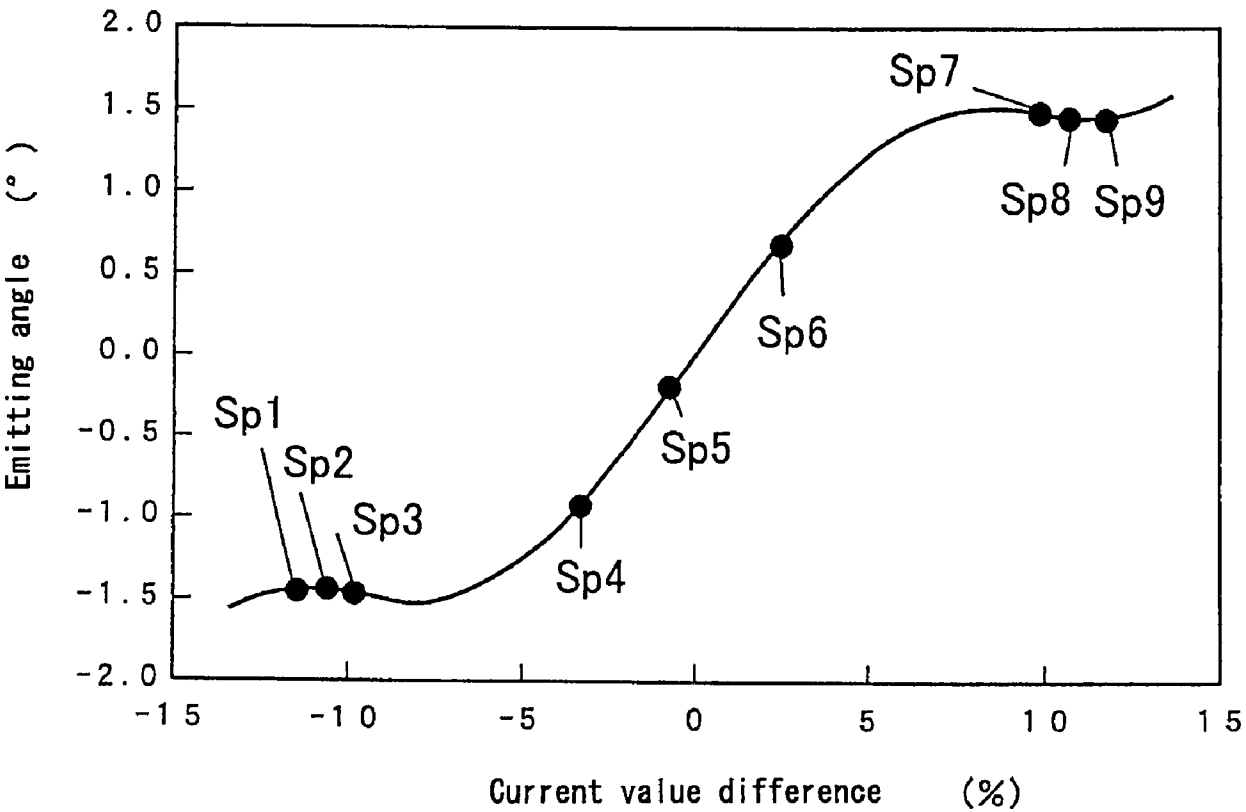
FIG. 17 is a graph showing the relationship between the angle of emission and the current value difference of the pulse currents supplied to a pair of heating resistors in the ink emitting head.
Figure 18A:
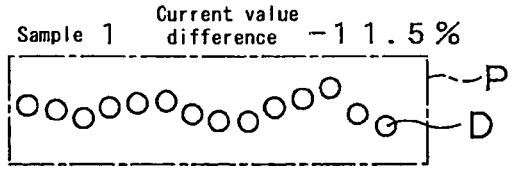
FIGS. 18A to 18I are schematic views showing points of deposition of ink droplets emitted from a nozzle when pulse currents having differential current values are supplied to a pair of heating resistors in the ink emitting head, with FIG. 18A showing the points of deposition for the current value differential of −11.5%, FIG. 18B showing the points of deposition for the current value differential of −10.5%, FIG. 18C showing the points of deposition for the current value differential of −10%, FIG. 18D showing the points of deposition for the current value differential of −3%, FIG. 18E showing the points of deposition for the current value differential of −1%, FIG. 18F showing the points of deposition for the current value differential of 2.5%, FIG. 18G showing the points of deposition for the current value differential of 10%, FIG. 18H showing the points of deposition for the current value differential of 10.5% and with FIG. 18I showing the points of deposition for the current value differential of 11.5%.
Figure 18B:
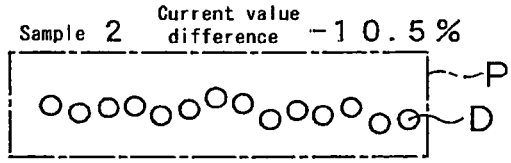
Figure 18C:
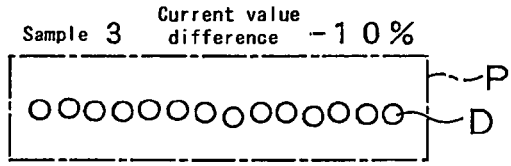
Figure 18D:
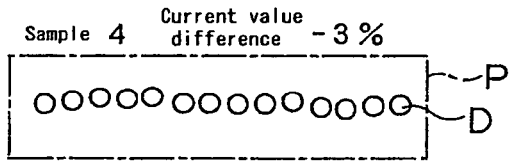
Figure 18E:
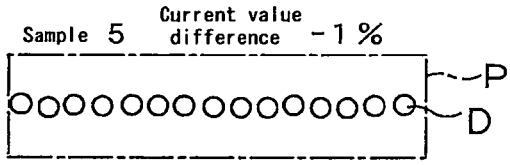
Figure 18F:
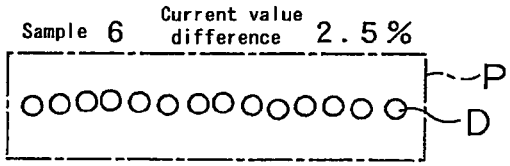
Figure 18G:
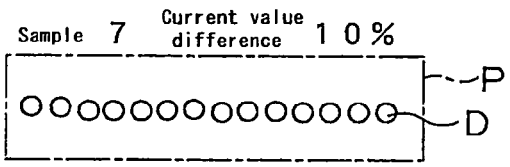
Figure 18H:
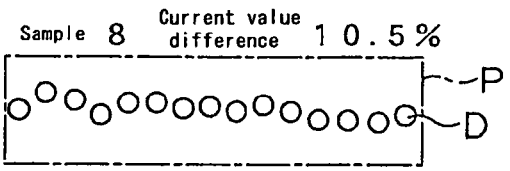
Figure 18I:
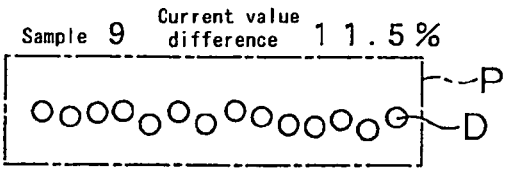

FIG. 17 shows the measured results of the angle of emission for different values of the difference in the pulse currents flowing through the heating resistors 42*a*, 42*b*, with the pulse current flowing through the heating resistor 42*a* being changed with respect to that flowing through the heating resistor 42*b*, with the case of emitting the ink droplet i substantially vertically downward from the nozzle 44*a* as a reference.

In FIG. 17, the abscissa denotes the current value difference of the pulse currents flowing through the paired heating resistors 42*a*, 42*b*, in terms of the ratio to the current value flowing through the heating resistor 42*b*. Specifically, the current value difference in case approximately the same currents flow through the paired heating resistors 42*a*, 42*b* is 0%, while the current value difference in case the pulse current flowing through the heating resistor 42*a* is of a smaller current value than that flowing through the heating resistor 42*b* is denoted with a minus (−) sign.

Moreover, in FIG. 17, the ordinate denotes the angle of emission when the ink droplet i has been emitted with variable emitting directions, with the case of emitting the ink droplet i substantially vertically downward from the nozzle 44*a* as reference. The angle of emission is indicated as 0° when the ink droplet i is emitted substantially vertically downward from the nozzle 44*a* and indicated with a minus (−) sign when the current value of the pulse current flowing through the heating resistor 42*a* is decreased such that the ink droplet i has been deposited offset towards the heating resistor 42*a*. In measuring this emission angle, the ink emitting head 27, in which the thickness of the nozzle sheet is set to approximately 13 μm and the diameter of the nozzle 44*a* is set to approximately 17 μm, was used.

It is seen from the measured results, shown in FIG. 17, that the direction of emission of the ink droplets i, emitted from the nozzle 44*a*, is changed by the current value difference caused in the pulse currents flowing through the paired heating resistors 42*a*, 42*b*. More specifically, when the current flowing through the heating resistor 42*a* is larger than the current flowing through the heating resistor 42*b*, the ink droplets i is emitted offset towards the side of the heating resistor 42*b*, whereas, when the current flowing through the heating resistor 42*a* is smaller than the current flowing through the heating resistor 42*b*, the ink droplets i is emitted offset towards the side of the heating resistor 42*a*.

In measuring the angle of emission of the ink droplet i, the points of deposition D on the recording paper sheet P of the ink droplets i, emitted from the nozzle 44*a* with the current value difference values of the pulse currents flowing through the paired heating resistors 42*a*, 42*b* of −11.5%, −10.5%, −10%, −3%, −1%, 2.5%, 10%, 10.5% and 11.5%, were set as samples 1 to 9, and measurements were made of the states of the points of deposition D on the recording paper sheet P of these sample 1 (Sp1) to sample 9 (Sp9). FIGS. 18A to 18I show the results of evaluation of the states of the points of deposition of these sample 1 (Sp1) to sample 9 (Sp9).

Meanwhile, for the sample 1 (Sp1) to sample 9 (Sp9), evaluation was made of the points of deposition of the ink liquid droplets i emitted from one of plural nozzles 44*a* arranged side-by-side along the width-wise direction of the recording paper sheet P.

It is seen from the results of evaluation of FIGS. 18A to 18I that, with the sample 3 (Sp3) to sample 7 (Sp7), for which the current value difference of the pulse current flowing through the heating resistor 42*a* and that flowing through the heating resistor 42*b* is within 10%, the points of deposition D of the ink droplets i are not varied after changing the direction of emission, but the ink droplets i are emitted at a constant angle of emission from the nozzle 44*a*.

In particular, with the sample 3 (Sp3) to sample 7 (Sp7), for which the current value difference of the pulse current flowing through the heating resistor 42*a* and that flowing through the heating resistor 42*b* is within ±10% (sample 3 (Sp3) to sample 7 (Sp7)), the variations of the angle of emission of the pulse currents, supplied to the paired heating resistors 42*a*, 42*b*, with respect to the current value difference of the pulse currents supplied to the paired heating resistors 42*a*, 42*b*, are larger. Thus, the control may be performed in stability by setting the upper limit of the current value difference to ±10%.

It is also seen that, with the samples 1, 2, 8 and 9, in which the current value difference of the pulse current flowing through the heating resistor 42*a* and that flowing through the heating resistor 42*b* exceeds 10%, as contrasted to the above samples, the points of deposition D of the ink droplets i are varied with changes in the direction of emission. Thus, in case the current value difference of the pulse currents flowing through the heating resistors 42*a* and 42*b* exceeds ±10%, the balanced state of the sizes of the ink droplets i, emitted from the nozzle 44*a*, becomes offset to destabilize the state of pressurizing of the ink 4, thus possibly producing variations in the direction of emission of the ink droplets i from the nozzles 44*a*.

On the other hand, in case the current value difference of the pulse currents flowing through the paired heating resistors 42*a*, 42*b* exceeds ±10%, the direction of emission of the ink droplets i from the nozzle 44*a* is excessively inclined, such that, when the ink droplets i are emitted from the nozzle 44*a*, the ink may be contacted with the edge of the nozzle 44*a*, thus producing variations in the emitting direction. That is, with the samples 1, 2, 8 and 9, the printed image is deteriorated in image quality because of variations in the points of deposition of the ink droplets i.

It is seen from above that controlling the current value difference of the pulse current flowing through the heating resistor 42*a* and that flowing through the heating resistor 42*b* to within ±10% and preferably to within ±8%, in changing the direction of emission of the of the ink droplets i from the nozzle 44*a*, is crucial for eliminating fluctuations in the emitting direction of the ink droplet i and for suppressing the variations in the points of deposition of the ink droplet i.

That is, with the above-described emission controller 63, the resistance value of the variable resistor 73 is controlled by the resistance value control circuit 75 when the ink droplets i are emitted from the nozzle 44*a* with variable emitting directions for adjusting the current values of the pulse currents supplied to the heating resistor 42*a* so that the current value difference of the pulse current flowing through the heating resistor 42*a* and that flowing through the heating resistor 42*b* will be within ±10%.

By so doing, the variations in the points of deposition of the ink droplets i, emitted from the nozzle 44*a* with variable emitting directions, may be suppressed, thereby prohibiting tone variations or white streaks to provide for printing to a high image quality.

In the foregoing, the current values supplied to the heating resistor 42*a* are adjusted by controlling the resistance value of the variable resistor 73. The present invention is not limited to this and, for example, the power source 71*a* may be connected to the heating resistor 42*a* for varying the current values supplied to the side of the heating resistor 42*b*. In this case, in emitting the ink droplets i with variable emitting directions, the emission controller 63 may adjust the resistance value of the variable resistor 73 by the resistance value control circuit 75 so that the current value difference of the pulse current flowing through the heating resistor 42*a* and that flowing through the heating resistor 42*b* will be within ±10%.

Figure 14:
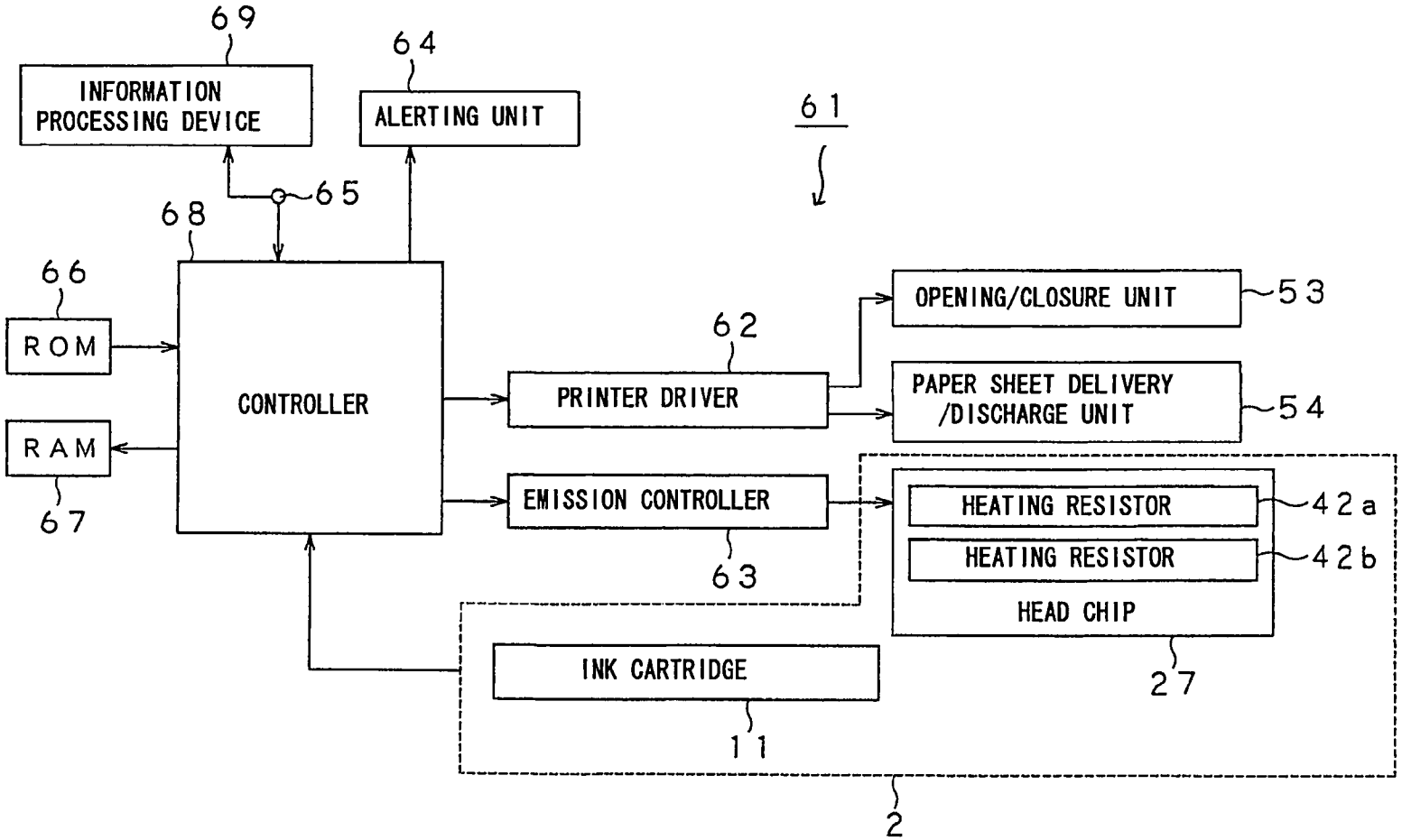
FIG. 14 is a schematic block diagram showing a control circuit of the ink jet printer apparatus.

The alerting unit 64, shown in FIG. 14, is a display means, such as LCD (liquid crystal display), and demonstrates the information, such as printing conditions, printing states or the residual ink quantities. The alerting unit 64 may, for example, be voice outputting means, such as a loudspeaker, in which case the information of, for example, the printing conditions, printing states or the residual ink quantities, is output by voice.

Meanwhile, the alerting unit 64 may own both the display means and the voice outputting means. The alerting may also be made using a monitor or a loudspeaker of an information processing system 69.

The input/output terminal 65 sends the above information, such as printing conditions, printing states or the residual ink quantities, to for example the external information processing system 69 over an interface. The input/output terminal 65 is also supplied with a control signal for outputting the above information, such as printing conditions, printing states or the residual ink quantities, or with e.g. printing data. The information processing system 69 is an electronic apparatus, such as, for example, a personal computer or a PDA (Personal Digital Assistance).

The input/output terminal 65, connected to for example the information processing system 69, may use, for example, a serial interface or a parallel interface, as interface, and is conformant to existing standards, specifically, the standards for USB (Universal Serial Bus), RS (Recommended Standard) 232C or IEEE (Institute of Electrical and Electronic Engineers) 1394.

The input/output terminal 65 may be configured to perform data communication with the information processing system 69 in accordance with a wired or wireless communication system. The relevant wireless communication standards may include IEEE802.11a, 802.11b and 802.11g.

Between the input/output terminal 65 and the information processing system 69 may be interposed a network, such as the Internet. In this case, the input/output terminal 65 is connected to for example LAN (Local Area Network), ISDN (Integrated Services Digital Network), xDSL (Digital Subscriber Line), FTHP (Fiber to The Home), CATV (Community Antenna Television) or BS (Broadcasting Satellite). Data communication is carried out in accordance with various protocols, such as TCP/IP (Transmission Control Protocol/Internet Protocol).

A ROM 66 is a memory, such as EP-ROM (Erasable Programmable Read-Only Memory), having stored therein a variety of programs for processing carried out by the controller 68. The programs stored in the ROM may be loaded on the RAM 67 by the controller 68. The RAM 67 stores the programs, read out by the controller 68 from the ROM 66, and the various states of the printer apparatus.

The controller 68 controls various components, based on for example the printing data, supplied from the input/output terminal 65, or on data on the residual quantity of the ink 4, entered from the head cartridge 2. The control programs for controlling various components based on for example the control signal as entered, are read out from the ROM 66, under control by the controller 68, and stored in the RAM 67, and various components are controlled or processed based on the processing program.

That is, the controller 68 controls the emission controller 63, based on for example the processing program, so that the current value difference of the pulse current flowing through the heating resistor 42*a* from that flowing through the heating resistor 42*b* will be within ±10%, such as not to produce variations in the emitting directions of the ink droplets i emitted from the nozzles 44*a*.

In the above-described control circuit 61, the processing programs are stored in the ROM 66. However, the processing programs do not have to be stored in the ROM 66, and a variety of recording mediums, such as optical discs, magnetic disc, magneto-optical discs or IC cards, having the processing programs stored therein, may also be used.

The control circuit 61 is arranged so that it is connected to a drive for driving various recording mediums, either directly or via information processing system 69, to read out processing programs from these recording mediums.

Figure 19:
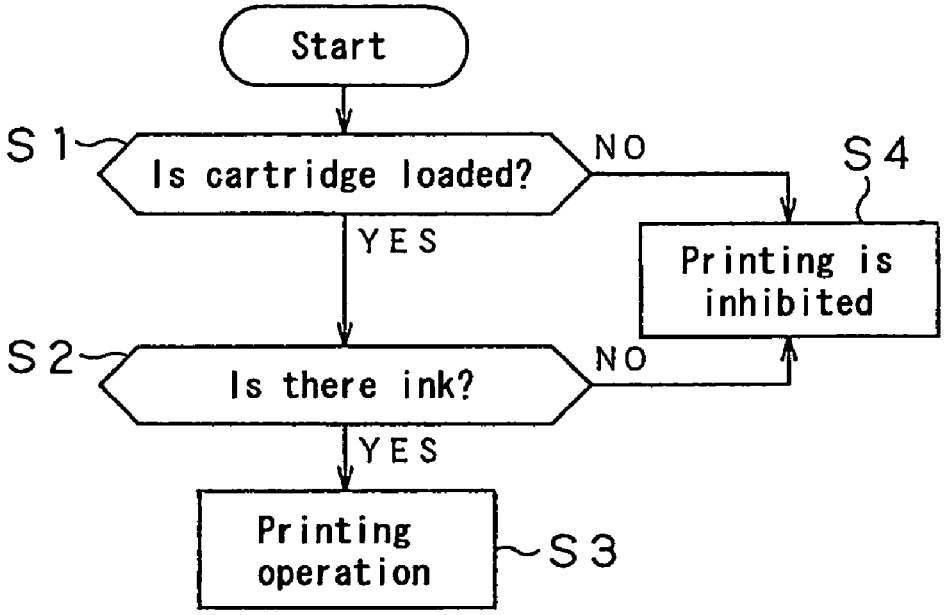
FIG. 19 is a flowchart for illustrating the printing operation of the ink jet printer apparatus.

The printing operation of the printing apparatus 1, arranged as described above, will now be explained with reference to the flowchart shown in FIG. 19. Meanwhile, the present printing operations are carried out by processing on a CPU (Central Processing Unit), not shown, provided in the controller 68, based on a processing program stored in storage means, such as ROM 66.

Initially, a user operates an operating panel, provided to the printer main 3, and issues a command to the printer apparatus 1 to carry out the printing operations. The controlling 68 then verifies, in a step S1, whether or not ink cartridges 11 of preset colors have been mounted to the respective mounting units 22.

If the ink cartridges 11 of preset colors have been adequately mounted to all of the mounting units 22, the controller 68 proceeds to a step S2. In case the ink cartridges 11 of preset colors have not been adequately mounted in the step S1, the controlling 68 proceeds to a step S4 to inhibit the printing.

The controller 68 in the step S2 verifies whether or not the quantity of the ink 4 in the connecting unit 26 is lesser than a preset value, that is, whether or not the ink 4 has become depleted. In case it is found that the ink 4 has become depleted, that effect is alerted in the alerting unit 64. The printing operation is then inhibited in the step S4.

If conversely the quantity of the ink 4 in the connecting unit 26 is in excess of a preset value, that is, if the ink 4 has been charged, the printing operation is allowed in a step S3.

Figure 20:
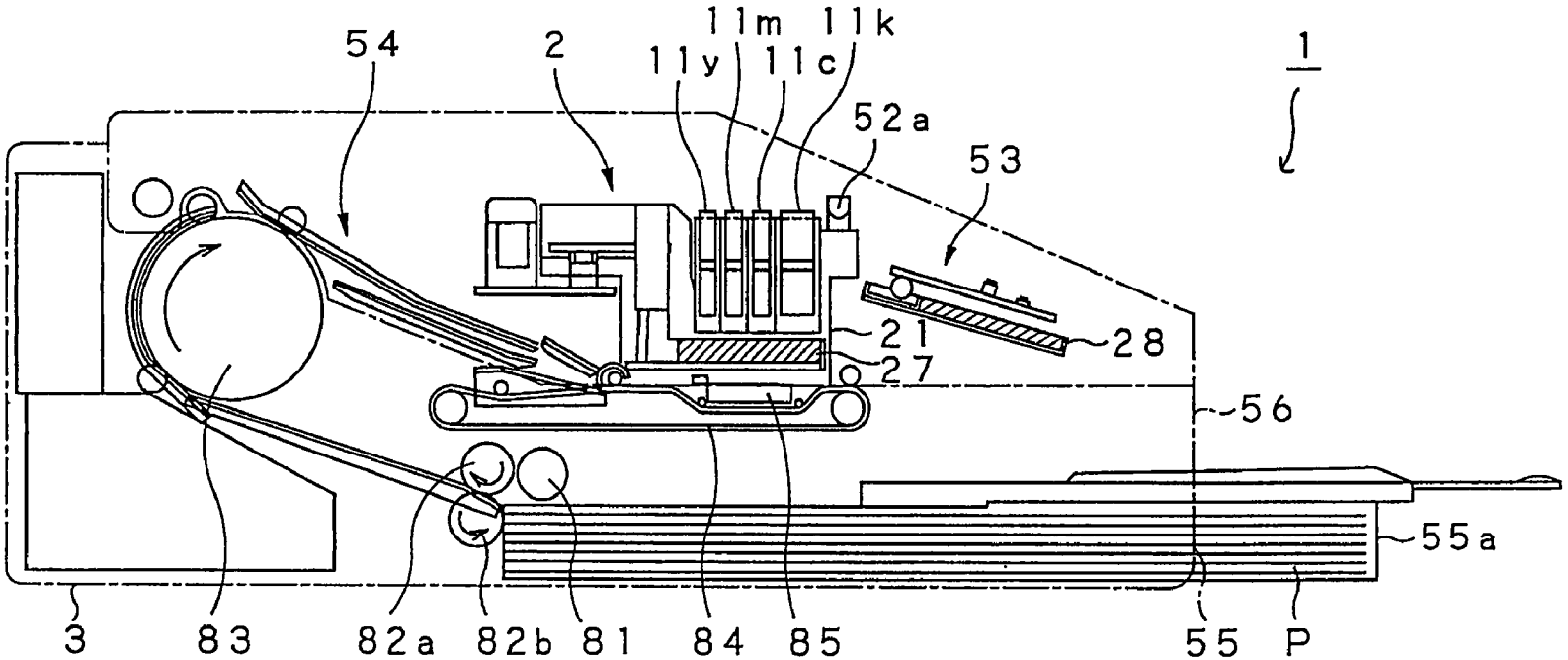
FIG. 20 is a side view showing the state in which a head cap opening/closing unit in the ink jet printer apparatus has been opened, with a portion thereof being shown in a see-through fashion.

In effecting the printing, the controller 68 performs driving control of the driving units 53 and 54 by the printer controller 62 to cause movement of the recording paper sheet P to a printing enabling position. Specifically, the controller 68 drives a driving motor of the head cap opening/closing unit 53 to cause movement of the head cap 28 towards the tray 55*a* with respect to the head cartridge 2 to expose the nozzles 44*a* of the ink emitting head 27, as shown in FIG. 20.

The controller 68 drives a driving motor, forming the paper sheet feed/discharge unit 54, to cause the running of the recording paper sheet P. Specifically, the controller 68 controls the paper sheet feed/discharge unit 54 so that a recording paper sheet P is pulled out from the tray 55*a* by the paper sheet feed roll 81 and sent to the inverting roll 83 by a pair of separating rolls 82*a*, 82*b*, rotating in opposite directions, the recording paper sheet P is then sent to a transporting belt 84, and the recording paper sheet P, transported to the transporting belt 84, is retained at a preset position by a retention means 85 to determine the position of deposition of the ink 4.

When the controller 68 has verified that the recording paper sheet P has been retained in the printing position, the controller 68 controls the emission controller 63 for emitting the ink droplets i towards the recording paper sheet P from the nozzles 44*a* of the ink emitting head 27.

Specifically, the controller controls the emission controller 63 so that, in case the ink droplet i is to be emitted substantially vertically downward from the nozzle 44*a*, the current values of the pulse currents supplied to the paired heating resistors 42*a*, 42*b* will be approximately equal to each other, as shown in FIG. 16A.

In case the ink is to be emitted from the nozzle 44*a* as the direction of emission is varied so that the ink will be emitted offset towards the heating resistor 42*a*, the controller 68 controls the emission controller 63 so that the current value of the pulse current supplied to the heating resistor 42*a* will be smaller than that of the pulse current supplied to the heating resistor 42*b*, as shown in FIG. 16B. In case the ink is to be emitted from the nozzle 44*a* so that the ink will be emitted offset towards the heating resistor 42*b*, the controller 68 controls the emission controller 63 so that the current value of the pulse current supplied to the heating resistor 42*a* will be larger than that of the pulse current supplied to the heating resistor 42*b*, as shown in FIG. 16C.

When the ink droplet i is to be emitted from the nozzle 44*a* as the direction of emission is changed, the controller 68 controls the emission controller 63 so that the current value difference of the pulse current flowing through the heating resistor 42*a* and that flowing through the heating resistor 42*b* will be within ±10%. Hence, in the ink emitting head 27, it is possible to suppress variations in the position of deposition of the ink droplet i, emitted from the nozzle 44*a* as the emitting direction is varied, as well as to prevent generation of color tone variations or white streaks.

When the ink droplet i has been emitted from the nozzle 44*a*, the same quantity of the ink 4 as the emitted quantity of the ink droplets i is quickly replenished from the ink flow duct 46 into the ink chamber 45 to restore the original state, as shown in FIG. 6B.

When the ink droplet i is emitted from the ink emitting head 27, and the negative pressure of the ink 4 in the portion of the ink chamber 34 located towards the ink outlet duct 34*c*, that is, the opening 34*d*, is raised, the diaphragm 34*i* is uplifted by atmospheric pressure, under the negative pressure of the ink 4. This uplifts the valve 34*e*, which has so far closed the opening 34*d* of the ink chamber 34*b* by the biasing force of the biasing member 34*f* and that of the diaphragm 34*i*, against the biasing force of the biasing member 34*f*, along with the valve shaft 34*h*, as shown in FIG. 6A. At this moment, the opening 34*d* between the side of the ink inlet duct 34*a* and the side of the ink outlet duct 34*c* of the ink chamber 34*b* is opened, so that the ink 4 is supplied from the side of the ink inlet duct 34*a* to the side of the ink outlet duct 34*c*. The ink 4 is replenished in the ink flow duct 46 of the ink emitting head 27. The negative pressure of the ink 4 is lowered and the diaphragm 34*i* is restored to its original shape, by its force of restoration. The valve 34*e* is pulled down, along with the valve shaft 34*h*, by the biasing force of the biasing member 34*f*, such as to close the ink chamber 34*b*. In the valving unit 34, the above-described sequence of operations is repeated when the negative pressure of the ink 4 is raised each time the ink droplet i is emitted.

In this manner, the letters/characters or images, which are in keeping with the printing data, are sequentially printed on the recording paper sheet P which is being run by the paper sheet feed/discharge unit 54. On completion of the printing, the recording paper sheet P is discharged via paper sheet discharge port 56 by the paper sheet feed/discharge unit 54.

In the above-described printer apparatus 1, when the ink droplet i is emitted from the nozzle 44*a* with variable emitting directions, the controller 68 controls the emission controller 63 so that, with the pulse current supplied to one of the paired heating resistors 42*a*, 42*b*, as reference, the pulse current having a current value difference within ±10% with respect to the reference pulse current will flow through the other of the paired heating resistors 42*a*, 42*b*. Specifically, the controller 68 controls the emission controller 63 so that the current value of the pulse current supplied to the heating resistor 42*a* will be different by within ±10% from the current value of the pulse current supplied to the heating resistor 42*b*, used in this case as reference.

By so doing, it is possible with the printer apparatus 1 to prevent an inconvenience that the emitting direction of the ink droplet i becomes variable due to offset size equilibrium of ink air bubbles formed on the paired heating resistors 42*a*, 42*b*, or that the ink droplet i is contacted with the edge of the nozzle 44*a* to cause variations in the emitting directions of the ink, when emitting the ink bubbles i from the nozzle 44*a* from variable emitting directions. The result is the suppressed variations in the positions of the points of deposition of the ink droplets i, emitted with variable emitting directions from the nozzle 44*a*. Since the variations in the positions of the points of deposition of the ink droplets in the printer apparatus 1 may be suppressed, printing may be made with high image quality, there being no deterioration of the image quality caused by tone variations or white streaks.

With the present printer apparatus, color density variations or white streaks may be prevented without providing overlaps during printing as is the case with the conventional apparatus. Hence, the image may be printed to high image quality in appreciably shorter printing time.

In the foregoing, the case of the ink emitting head 27, in which the paired heating resistors 42*a*, 42*b* are juxtaposed along the width-wise direction of the recording paper sheet P, has been taken as an example for explanation. The present invention is not limited to this case and may, for example, be applied to ink emission heads 91, 101 and 111, shown for example in FIGS. 21A to 21C, provided that the direction of emission of the ink droplet i is controlled by varying the current values of the pulse currents supplied to the plural pressure generating devices.

In an ink emitting head 91, paired heating resistors 92*a*, 92*a* are juxtaposed along the running direction of the recording paper sheet. In an ink emitting head 101, three heating resistors 103*a*, 103*b* and 103*c* are arranged in an ink chamber 102. In an ink emitting head 111, four heating resistors 113*a*, 113*b*, 113*c* and 113*d* are arranged in an ink chamber 112.

Figure 21A:
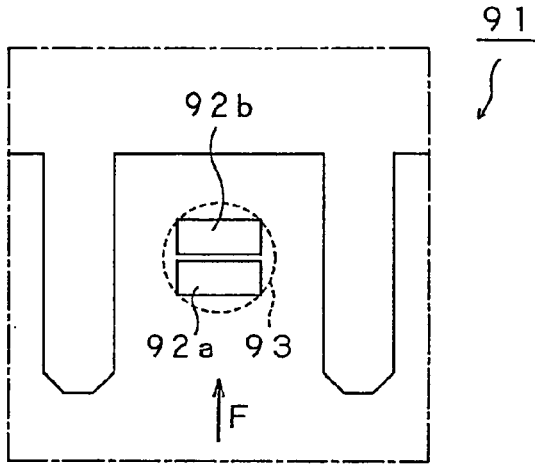
FIGS. 21A to 21C are plan views showing other instances of an ink emitting head, with FIG. 21A showing the state in which heating resistors are arranged side-by-side along the running direction of the recording paper sheet, FIG. 21B showing the state in which three heating resistors are provided in an ink chamber and FIG. 21C showing four heating resistors are provided in an ink chamber.
Figure 21B:
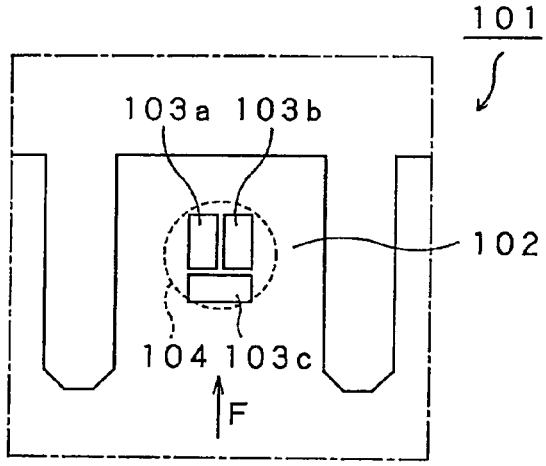
Figure 21C:
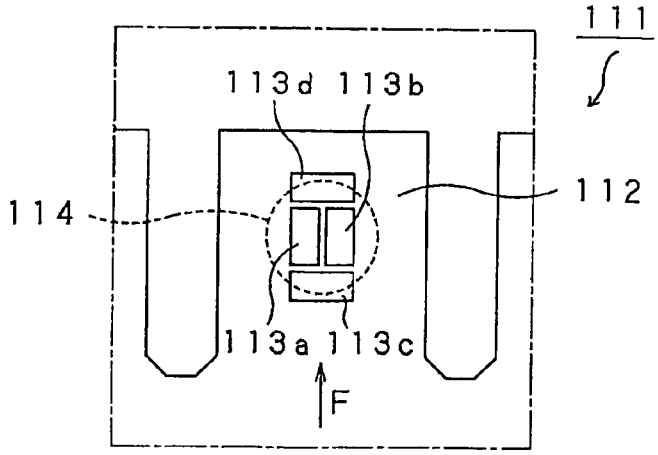
Figure 22:
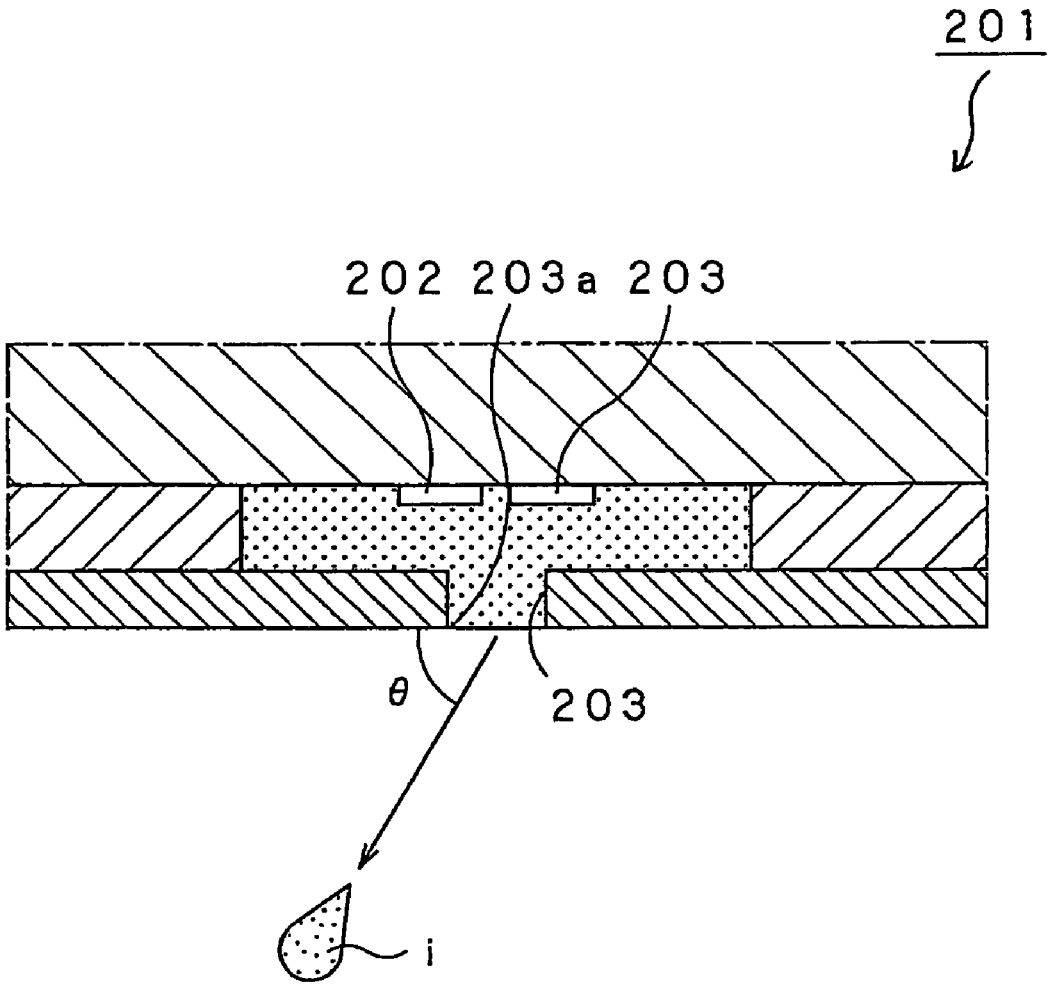
FIG. 22 is a schematic cross-sectional view showing a conventional liquid emitting head.

In FIGS. 21A to 21C, the positions of the nozzles 93, 104 and 114 in the ink emitting heads 91, 101, 111 are indicated by dotted lines. In the ink emitting heads 101, 111, the heating resistors 103*c*, 113*c*, provided on the ink duct side, are provided for preventing the situation in which the pressure for discharging the ink droplet i from the nozzles 104, 114 in case of breakage of the ink bubbles generated in the ink chambers 102, 112 becomes lower on the ink duct side than on the sidewall side with the result that the ink droplet i is emitted in the direction of supplying the ink 4 from the ink duct, that is, in the direction opposite to the direction shown by arrow F in FIGS. 21A to 21C.

In the foregoing, the printer apparatus 1 in which the head cartridge 2 may be detached from the printer main 3 and the ink cartridge 11 may be detached from the head cartridge 2. The present invention may, however, be applied to a printer apparatus in which the printer main 3 is made as one with the head cartridge 2.

In the foregoing, the printer apparatus 1 for printing letters/characters or images on the recording paper sheet has been taken as an example for explanation. However, the present invention may be broadly applied to other apparatus emitting minor quantities of a liquid material. For example, the present invention may be applied to an apparatus for emitting DNA chips in a liquid as disclosed in JP Laid-Open Patent Publication 2002-34560, or to a liquid emitting apparatus for emitting a liquid containing electrically conductive particles used for forming miniaturized interconnection patterns for a printed circuit board.

In the foregoing explanation, an electro-thermal conversion system in which the ink 4 is emitted from the nozzle 44*a* as the ink is heated by the paired heating resistors 42*a*, 42*b* is used. However, the present invention is not limited to this system and may, for example, be applied to an apparatus employing an electromechanical conversion system in which the ink is emitted electromechanically from the nozzle by an electro mechanical transducing elements, such as piezo elements.

The present invention has been explained taking the case of a line head type printer apparatus 1 as an example. However, the present invention may also be applied to a serial ink jet printer apparatus, in which an ink head is moved in a direction substantially at right angles to the running direction of the recording paper sheet. In this case, at least a plural number of pressure generating elements are provided to the ink jet emitting head of the serial ink jet printer apparatus.

The present invention is not limited to the above-described embodiments explained above with reference to the drawings. It will be appreciated that various changes or substitutions by equivalents may be attempted by those skilled in the art without departing from the scope of the invention as defined in the appended claims.

The invention claimed is:

1. A liquid emitting apparatus including a plurality of liquid chambers for storing liquid arrayed in a line print head wherein each liquid chamber includes two or more pressure generating elements provided in said liquid chamber for pressurizing the liquid stored in said liquid chamber, an emitting port for emitting the liquid pressurized by said pressure generating elements in the form of liquid droplets, and an emission control circuit for varying a current value supplied to at least one of said pressure generating elements relative to one of the other pressure generating elements to thereby control an angle of emission of said liquid droplets from said emitting ports; wherein with a non-zero current supplied to one of said pressure generating elements as a reference current, said emission control circuit supplies a current substantially equal to said reference current or a current having a current value difference less than ±10% from said reference current, to one or more of the pressure generating elements other than the pressure generating element supplied with said reference current, and further wherein none of the liquid chambers in the line print head has a pressure generating element that receives a current having a current value difference that is greater than 10% from the corresponding reference current, and further comprising circuitry for limiting a current value difference to less than 10% for all ejecting elements of the liquid emitting apparatus for all ink ejection operations.

2. The liquid emitting apparatus according to claim 1 wherein said emission control circuit supplies a current having a current value difference less than ±8% with respect to said reference current to the one or more of the pressure generating elements other than said pressure generating element supplied with said reference current.

3. The liquid emitting apparatus according to claim 1 wherein the emitting ports are arranged side-by-side in a line.

4. The liquid emitting apparatus according to claim 1, wherein said emission control circuit is comprised of one or more switches and a variable resistance element.

5. The liquid emitting apparatus according to claim 4, wherein the current value applied to said one or more of the pressure generating elements other than the pressure generating element supplied with said reference current is varied relative to the variation of the resistance of said variable resistance element.

6. The liquid emitting apparatus according to claim 4, wherein said emission control circuit is comprised of the variable resistance element connected to a first terminal of each of said pressure generating elements via a first switch, and said variable resistance element is selectively connected to a first potential power source and a second potential power source different via a second switch.

7. The liquid emitting apparatus according to claim 6, further wherein said pressure generating element supplied with a non-zero reference current has a second terminal thereof connected to a third potential power source, and each of said one or more pressure generating elements other than the pressure generating element supplied with said reference current has a second terminal thereof selectively connected to a fourth potential power source via one or more third switches.

8. The liquid emitting apparatus according to claim 7, wherein said first and fourth potential power sources are a ground level.

9. The liquid emitting apparatus according to claim 6, wherein said first and second switches are respectively controlled via first and second switch control circuits, said first control circuit causing the variable resistance element to be connected to and disconnected from said pressure generating elements, and said second control circuit determining whether the variable resistance element is connected to said first or said second potential power source.

10. A liquid emitting method for printing with a liquid emitting apparatus including a plurality of liquid chambers for storing liquid arrayed in a line print head wherein each liquid chamber includes two or more pressure generating elements provided in said liquid chamber for pressurizing the liquid stored in said liquid chamber, an emitting port for emitting the liquid pressurized by said pressure generating elements in the form of liquid droplets, and an emission control circuit for varying a current value supplied to at least one of said pressure generating elements relative to one of the other pressure generating elements to thereby control an angle of emission of said liquid droplets from said emitting ports; wherein with a non-zero current supplied to one of said pressure generating elements as a reference current, a current substantially equal to said reference current or a current having a current value difference less than ±10% from said reference current, is supplied to one or more of the pressure generating elements other than the pressure generating element supplied with said reference current, and further wherein none of the liquid chambers in the line print head has a pressure generating element that receives a current having a current value difference that is greater than 10% from the corresponding reference current during a printing operation, and further comprising circuitry for limiting a current value difference to less than 10% for all ejecting elements of the liquid emitting apparatus for all ink ejection operations.

11. The liquid emitting method according to claim 10 wherein a current having a current value difference less than ±8% with respect to said reference current is supplied to the one or more of the pressure generating elements other than said pressure generating element supplied with said reference current.

12. The liquid emitting method according to claim 10 wherein the emitting ports are arranged side-by-side in a line.

13. The liquid emitting method according to claim 10, wherein said emission control circuit is comprised of one or more switches and a variable resistance element.

14. The liquid emitting method according to claim 13, wherein said step of supplying a substantially equal current to one or more of the pressure generating elements other than the pressure generating element supplied with said reference current includes varying the resistance of the variable resistance element.

15. The liquid emitting method according to claim 13, wherein said emission control circuit is comprised of the variable resistance element connected to a first terminal of each of said pressure generating elements via a first switch, and said variable resistance element is selectively connected to a first potential power source and a second potential power source different via a second switch.

16. The liquid emitting method according to claim 15, further wherein said pressure generating element supplied with a non-zero reference current has a second terminal thereof connected to a third potential power source, and each of said one or more pressure generating elements other than the pressure generating element supplied with said reference current has a second terminal thereof selectively connected to a fourth potential power source via one or more third switches.

17. The liquid emitting method according to claim 16, wherein said first and fourth potential power sources are a ground level.

18. The liquid emitting method according to claim 15, wherein said first and second switches are respectively controlled via first and second switch control circuits, said first control circuit causing the variable resistance element to be connected to and disconnected from said pressure generating elements, and said second control circuit determining whether the variable resistance element is connected to said first or said second potential power source.

* * * * *